US012377310B2

(12) United States Patent
Lowenstein

(10) Patent No.: US 12,377,310 B2
(45) Date of Patent: Aug. 5, 2025

(54) FACTORY WORKOUT APPARATUS

(71) Applicant: Evan Mitchell Lowenstein, Melbourne, FL (US)

(72) Inventor: Evan Mitchell Lowenstein, Melbourne, FL (US)

( * ) Notice: Subject to any disclaimer, the term of this patent is extended or adjusted under 35 U.S.C. 154(b) by 232 days.

(21) Appl. No.: 18/078,237

(22) Filed: Dec. 9, 2022

(65) Prior Publication Data

US 2023/0181965 A1 Jun. 15, 2023

Related U.S. Application Data

(60) Provisional application No. 63/288,396, filed on Dec. 10, 2021.

(51) Int. Cl.

| | |
|---|---|
| ***A63B 21/00*** | (2006.01) |
| ***A63B 21/06*** | (2006.01) |
| ***A63B 24/00*** | (2006.01) |
| ***A63B 71/00*** | (2006.01) |
| ***A63B 71/06*** | (2006.01) |

(52) U.S. Cl.

CPC ..... *A63B 21/4043* (2015.10); *A63B 21/06* (2013.01); *A63B 24/0087* (2013.01); *A63B 71/0036* (2013.01); *A63B 2071/0625* (2013.01); *A63B 2071/0694* (2013.01); *A63B 2225/093* (2013.01)

(58) Field of Classification Search

CPC . A63B 21/4043; A63B 21/06; A63B 24/0087; A63B 71/0036; A63B 2071/0625; A63B 2071/0694; A63B 2225/093; A63B 2024/0096; A63B 2071/063; A63B 2225/20; A63B 2225/54; A63B 21/072; A63B 69/0053; A63B 2220/10; A63B 2220/801; A63B 2220/805; A63B 2225/50; A63B 71/0622

See application file for complete search history.

(56) References Cited

U.S. PATENT DOCUMENTS 3,350,097 A * 10/1967 Chevrette ..... A63B 63/08 273/350
3,586,323 A * 6/1971 Carter ..... A63B 67/007 273/440
4,863,174 A * 9/1989 Cummings ..... A63B 67/083 473/509
5,060,940 A * 10/1991 Mullen ..... A63B 69/0071 273/396
5,171,009 A * 12/1992 Filewich ..... A63B 63/083 473/433
5,312,285 A * 5/1994 Rieber ..... A63F 7/3622 273/109
5,370,391 A * 12/1994 Hilzendeger ..... A63F 7/3622 273/120 R
5,522,598 A * 6/1996 Loyd ..... A63B 63/08 273/402
5,531,356 A * 7/1996 Baker ..... A63B 47/002 312/49
5,632,490 A * 5/1997 Brown ..... A63F 7/048 273/350
5,665,004 A * 9/1997 Vlahovic ..... A63B 57/0006 473/137

(Continued)

*Primary Examiner* — Andrew S Lo
(74) *Attorney, Agent, or Firm* — Brown Rudnick LLP; Matthew P. York

(57) ABSTRACT

The present disclosure provides novel exercise apparatuses and methods of using the same.

6 Claims, 24 Drawing Sheets

(56) References Cited

U.S. PATENT DOCUMENTS

| | | | | | |
|---|---|---|---|---|---|
| 5,692,976 | A * | 12/1997 | Yu | A63B 69/0071 | 473/433 |
| 5,836,837 | A * | 11/1998 | Craig | A63B 67/002 | 473/433 |
| 6,142,890 | A * | 11/2000 | Craig | A63B 63/08 | 473/433 |
| 6,419,589 | B1 * | 7/2002 | Carter | A63B 57/0006 | 221/277 |
| 6,843,241 | B1 * | 1/2005 | Newcomer | A63B 69/407 | 124/16 |
| 6,929,556 | B1 * | 8/2005 | Wolbert | A63B 57/0006 | 473/137 |
| 9,114,271 | B1 * | 8/2015 | Brown | A63B 23/0458 | |
| D793,498 | S * | 8/2017 | Manus | D21/699 | |
| 9,925,471 | B2 * | 3/2018 | Flores | A63H 18/00 | |
| D977,034 | S * | 1/2023 | Wu | D21/564 | |
| 2002/0082125 | A1 * | 6/2002 | Markin | A63B 69/406 | 473/451 |
| 2002/0151372 | A1 * | 10/2002 | Montalvo | A63B 57/0006 | 473/134 |
| 2007/0142131 | A1 * | 6/2007 | McBride | A63B 69/406 | 124/78 |
| 2017/0368433 | A1 * | 12/2017 | Nelson | A63B 69/407 | |
| 2019/0308052 | A1 * | 10/2019 | Mendolia | G06T 19/003 | |
| 2024/0226697 | A1 * | 7/2024 | Judge | A63B 69/002 | |

* cited by examiner

FACTORY WORKOUT APPARATUS

CROSS-REFERENCE TO RELATED APPLICATIONS

This application claims the benefit of and priority to U.S. Provisional Application No. 63/288,396, filed on Dec. 10, 2021, the contents of which are incorporated herein by reference in their entirety.

FIELD OF DISCLOSURE

The disclosure relates to workout apparatuses and methods of using the same.

BACKGROUND

Fitness equipment is generally used for physical exercise and rehabilitation therapies, such as in physical and cognitive therapy. Fitness equipment facilitates performing exercises, such as aerobic exercise to improve or maintain cardiovascular health, resistance training that targets muscles, and flexibility training to maintain or increase a person's freedom of movement and reduce incidence of injury.

Resistance training often uses specific movements against a resistance to target specific muscle groups. Often, resistance is provided by elastic bands, free weights, weight machines, and/or body weight, such as in plyometric training. Aerobic exercise is often performed using machines such as treadmills, stationary bicycles, ergometers and other kinds of equipment.

Physical therapy is often required after injury, illness, and/or a medical procedure. Depending on the nature of the injury, illness, or medical procedure, physical therapy usually includes a combination of aerobic, strength, and/or flexibility training. Effective physical therapy regimes generally require adapted or modified exercise movements that account for a patient's limitations and which can be changed as a patient progresses with the therapy. Cognitive rehabilitation therapy (CRT) is a type of physical therapy designed to improve (restorative CRT) or maintain (compensatory CRT) a person's cognitive function by employing therapy regimes that incorporate physical activity. Often, this physical activity is paired with a neuro-stimulus. It is thought that concurrent mental and physical activities synergize to provide enhanced cognitive improvements.

Given the numerous types exercises, exercise goals and purposes, and increasing numbers of people who regularly partake in physical activities, there are few workout modalities or machines that lend themselves to a wide range of exercise types that accommodate any combination of aerobic, resistance, flexibility, and physical therapy exercises. There are fewer still that allow for large, compound movements, which are known to be particularly effective.

SUMMARY

The present invention provides exercise apparatuses and methods for using them. The apparatuses of the present invention generally task a user with removing weighted items from one part of the machine and placing them on another part of the machine. The weighted items are free standing, e.g., weighted bags, weighted balls, kettle bells, weighted objects of proprietary configuration and the like. Thus, when using an apparatus of the invention, a user moves a free-standing weighted item from point A (a first platform or tube opening) to point B (a second platform or tube opening) and releasing the weight upon completion of the move/repetition.

The present invention is based on the discovery that natural movements, often associated with manual labor, e.g., picking up and placing heavy objects in a warehouse, can provide a quick, fully-body workout quickly. Depending on the intensity, weight, speed, and duration of a workout using the apparatuses of the invention, workouts with aerobic, anaerobic, and combinations thereof can be performed. Moreover, because the apparatuses of the invention can be used with largely-familiar, natural movements, the apparatuses of the invention can be used correctly by many individuals with minimal or no training on proper form to complete the movements of a workout. This departs from nearly every type of exercise using free-weights, which often lead to severe injury when performed with even minor deviations from correct form. Furthermore, because the natural movements of the invention are fairly ubiquitous, the apparatuses of the invention are more approachable, and thus more likely to be used, by individuals who are generally hesitant or resistant to exercise.

Additionally, because the apparatuses of the invention are able to mimic a natural movements, certain apparatuses of the invention can be designed (e.g., the appearance of the apparatus/weighted objects or audio-visual displays, which lend a "theme" to the apparatus. These "themes" (for example, an industrial, construction, and factory theme) may be used to attract and encourage users that would otherwise not interact with a piece of fitness equipment.

In certain aspects, a weighted item or object placed by a user on a part of the machine will remain in position or on the part of the machine (e.g., a platform, shelf, cubby, compartment, container, etc.) until the user moves it elsewhere. In other cases, the apparatus will move the item to another location, e.g., via a conveyor belt, slide, and/or other means as described herein.

In certain aspects, an apparatus of the invention includes a plurality of platforms of varying height. For example, an apparatus may have platforms at three distinct heights, e.g., high, medium, and low. The platforms may wrap around a central support beam, frame or body. Pairs of platforms may be connected by a surface, which may include rollers and/or conveyor belts that move weighted objects between connected platforms in either direction and at varying speeds. Thus, for example, in certain aspects, a user lifts a weighted item off a platform that is moving weights towards the user and places it on a platform moving away from the user.

Additionally or alternatively, an apparatus of the invention may include a motor that slightly tilts the platforms so that one side is higher than the other. The platform may be composed of a material that allows items placed on the upper side to roll/slide down to the lower side. Alternatively, the user is tasked with creating enough force to cause the item (e.g., a ball) to roll around the surface to a connected platform.

In certain aspects, an apparatus may be configured such that two users, standing on opposite sides of the machine are able to concurrently use the apparatus—preferably in a cooperative or competitive manner. Similarly, in certain aspects, more than one apparatus may be in electronic communication, using wired or wireless connection methods, allowing users of the connected machines to compete against one another.

In certain aspects, an apparatus of the present invention includes slides or tubes that crisscross from high to low. The user begins by picking up a weighted item either from the bottom of either slide (the left or the right). The user then lifts the item and places it at the top of either slide. The item will then slide back down to the opposite side of where the item was placed. Thus, for example, if the user places an item on the top right slide, it will end up on the bottom left.

In certain aspects, the present invention includes an exercise apparatus comprising: a central body comprising a base, a front surface, a back surface, a left surface and a right surface; one or more sets of opposing platforms, each platform attached to the central body via one or more support members wherein one platform of a set is disposed proximal to the left surface and the other platform disposed proximal to the right surface; and one or more weighted objects, enabling a user facing the front surface to lift a weighted object from one platform and deposit it on another.

The apparatus may include a plurality of sets of opposing platforms. In certain preferred aspects, the apparatus includes three sets of opposing platforms.

In certain apparatuses, the height of each set of platforms relative to the base of the central body is adjustable. Similarly, a distance from which each platform of a set is disposed relative to the central body may be adjustable.

In certain aspects, each platform of a set is connected via a surface that extends from one platform in a direction towards that back surface and annularly around the central body where it connects to an opposing platform. A weighted object placed on a platform by a user is moved to the opposing platform along the surface connecting the platforms.

The surface may include a conveyor belt that moves the weighted object between platforms. A portion of the surface connecting the platforms may include a low friction surface before and after the conveyor belt. The low friction surface may include, for example, ball bearings along which the weighted object moves. In certain aspects, the conveyor belt is removable enabling two users to use the apparatus concurrently, e.g., one positioned in front and the other positioned behind the central body.

The apparatus may further include a control unit coupled to one or more sensors that detect the presence or absence of a weighted object on a platform. The control unit may be coupled to a motor that drives the conveyor belt such that when the sensor detects a weighted object on a platform the control unit stops the conveyor belt. The control unit may be coupled to a motor that drives the conveyor belt such that when the sensor detects a weighted object on a platform the control unit starts the conveyor belt thereby moving the weighted object to the opposing platform.

In certain aspects, each platform of a set is disposed at a different height relative to the base such that when a user places a weighted object on the higher platform, the weighted object travels along the surface to the opposing platform.

In certain aspects, the apparatus comprises a control unit coupled to an interface that provides instructions to a user. For example, interface may provide instructions to the user to move a weight from one platform to another platform.

In certain aspects, the interface comprises a screen disposed in the front surface of the central body. In certain aspects, the interface comprises one or more of a speaker and/or lights associated with each platform. Each platform may be uniquely designated, e.g., by a color, and the interface instructs a user to move a weighted object to a platform using the designation.

In certain aspects, each platform comprises a four or five sided cubby into which a weighted object is placed by a user.

The present invention also provides an exercise apparatus comprising: a central body comprising a base; a plurality of tubes, wherein each tube comprises an upper opening and lower opening; and one or more weighted objects, enabling a user to lift a weighted object from a lower opening of one of the tubes and depositing in the upper opening of one of the tubes such the object slides to a lower opening in of one of the tubes.

In certain aspects, the tubes intersect one another between their respective upper and lower openings. The intersection of the tubes may include a flap that directs a weighted object deposited into an upper opening of a tube to slide into the lower opening of a desired tube.

DETAILED DESCRIPTION

The present invention provides exercise apparatuses and methods for using them. The apparatuses of the present invention generally task a user with removing weighted items from one part of the machine and placing them on another part of the machine. The weighted items are free standing, e.g., weighted bags, weighted balls, kettle bells, weighted objects of proprietary configuration and the like. Thus, when using an apparatus of the invention, a user moves a free-standing, weighted item from point A (a first platform or tube opening) to point B (a second platform or tube opening) and releases the weight upon completion of the move/repetition.

Figure 1:
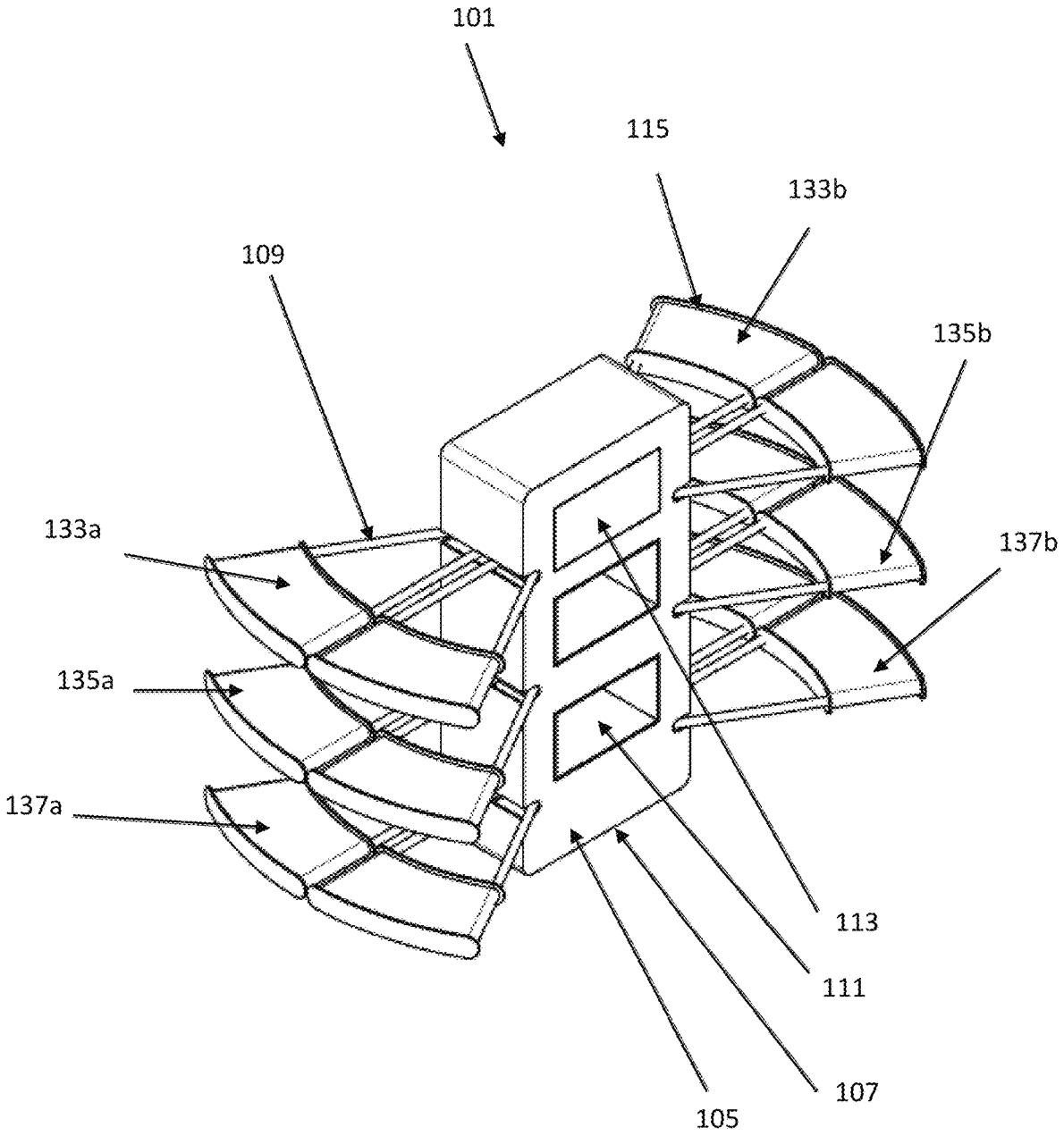
FIG. 1 shows a perspective view of an apparatus of the disclosure.

FIG. 1 provides a schematic of an exemplary apparatus 101 of the invention. As shown, the apparatus includes a central body 105 with a base 107. The apparatus may include one or more sets of opposing platforms (133*a/b*, 135*a/b*, 137*a/b*). Each platform is attached to the central body via one or more support members 109. As shown, the sets of opposing platforms may be disposed at different heights relative to the base. The central body may include one or more storage spaces 111, which may be used to store free standing weighted objects used with the apparatus. The central body may also include an interface 113, such a display, which is coupled to a control module.

In certain embodiments, the central body is an open frame, rather than the configuration with body panels shown in FIG. 1. In certain aspects, the central body may be mounted on a horizontal surface, like a wall. Alternatively, in certain aspects, an apparatus of the invention may include a series of pedestals of platforms mounted to a larger structure, like a wall.

Figure 30:
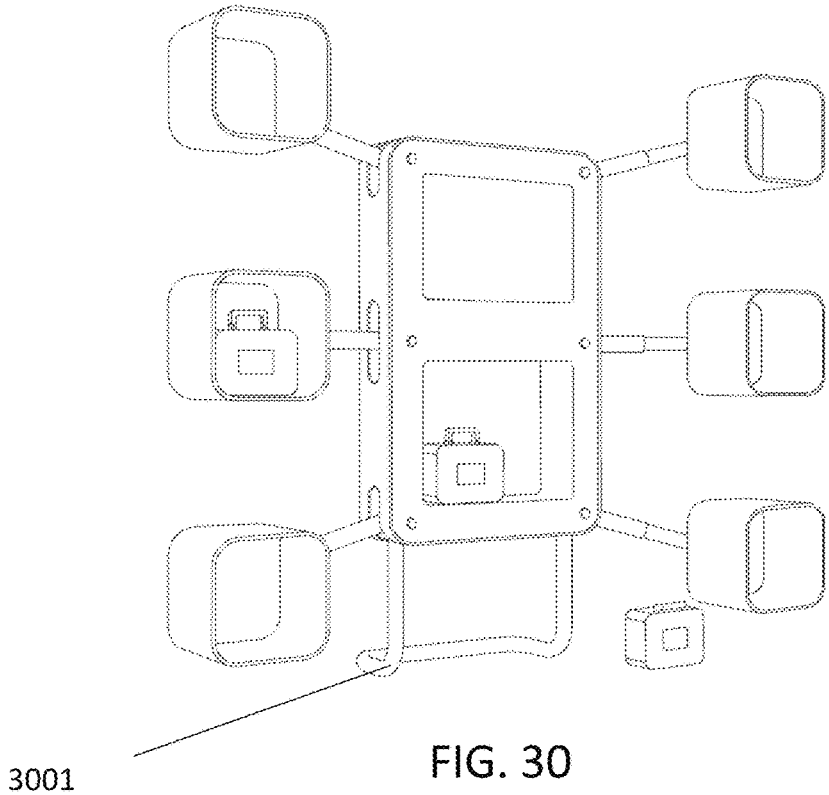
FIG. 30 shows an apparatus of the invention that uses a combination of wall mounting with a small base on the floor.
Figure 31:
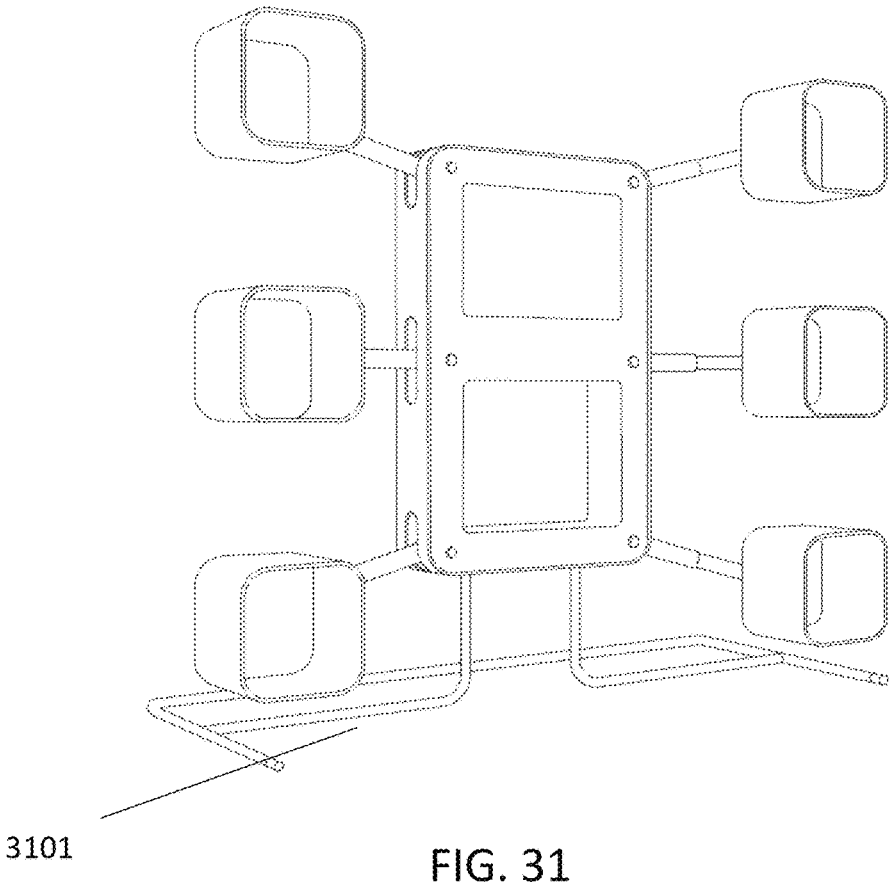
FIG. 31 shows an apparatus of the invention designed such that it does not require fixation to a wall.

As shown in FIGS. 30-31, apparatuses of the invention may include a base (3001 and 3101) supporting the apparatus on the floor. In certain aspects, a smaller base 3001 may be used where the apparatus does not use heavy weights and/or where the apparatus is also mounted to a wall or other surface. As shown in FIG. 31, when an apparatus of the invention is used with heavy weights and/or without the ability to mount to a wall, a larger base 3101 may be used. In certain apparatuses of the invention, the base (e.g., large or small) may be swapped for a base that meets the requirements of the apparatus' placement/use.

Figure 32:
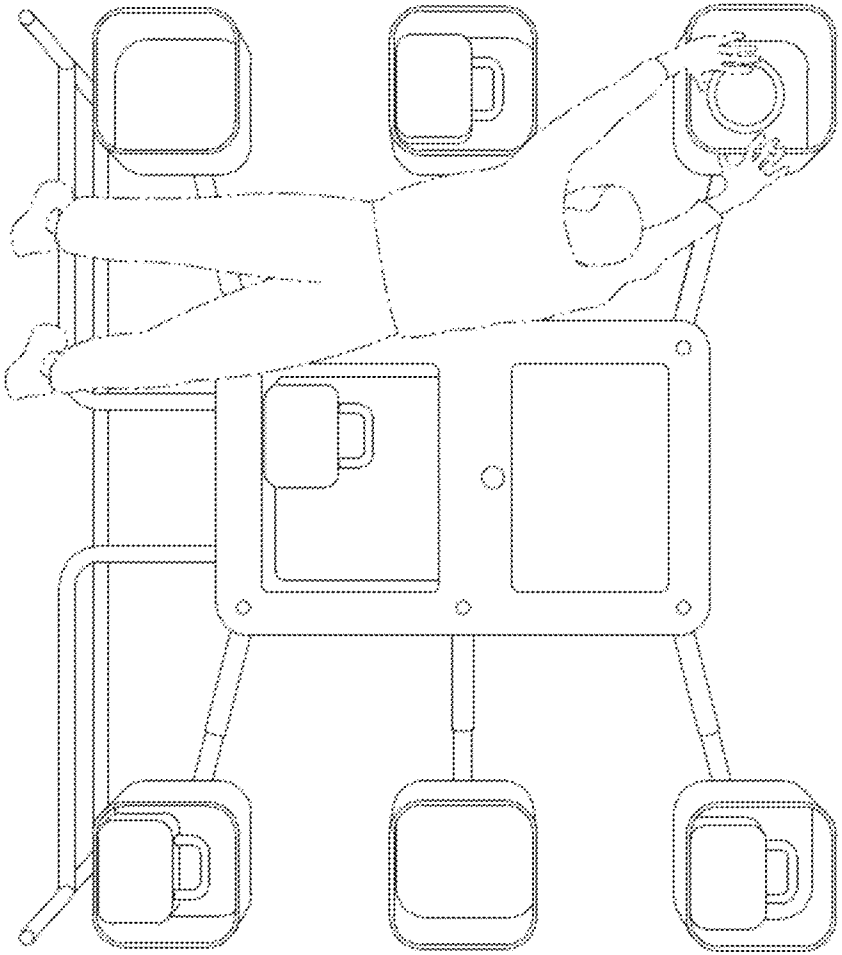
FIG. 32 shows an apparatus of the invention relative to a normal adult user.

As shown in FIG. 32, a user may remove a weighted object from one platform of the machine and place it on another part of the machine. Thus, when using an apparatus of the invention, a user moves a free-standing weighted item from point A (a first platform) to point B (a second platform) and releasing the weight upon completion of the move/repetition. In certain aspects, an interface, such as the display 113 shown in FIG. 1 may provide a user with prompts for lifting a weighted object from a particular platform and setting it on a different platform.

Figure 33:
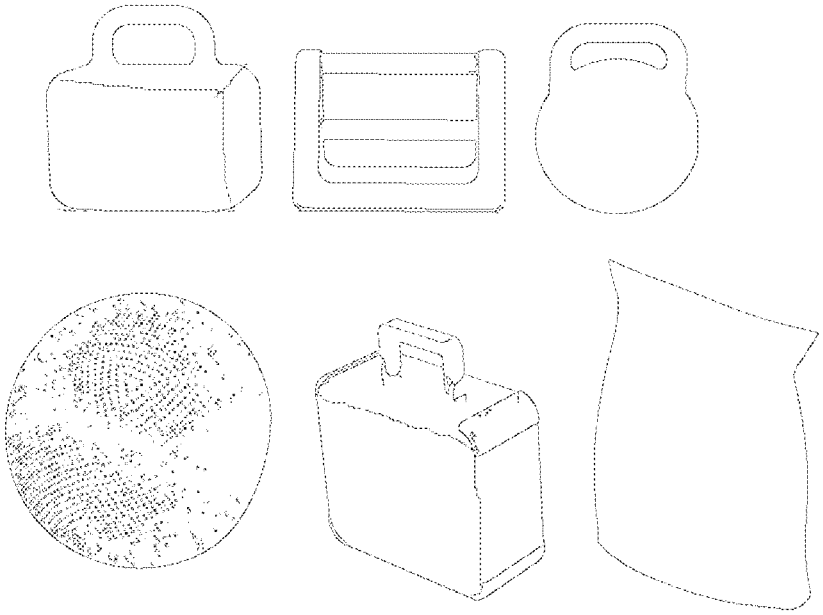
FIG. 33 shows various weighted objects that can be used with an apparatus of the invention.

As shown in FIG. 33, weighted objects of the invention may take several forms. Preferably, as provided in FIG. 33, the weighted objects are free-standing, e.g., weighted bags, weighted balls, kettle bells, weighted objects of proprietary configuration and the like. In certain apparatuses of the invention, the weighted objects are rigid, which as described herein may allow the weight to travel through the apparatus. Alternatively or additionally, apparatuses of the invention may be configured to use non-rigid weights, such as a weighted bag or medicine ball, which prevents the object from rolling or moving off when placed. Further, by permitting the use of both hard and soft weighted objects, the apparatuses of the invention may be better able to mimic a natural movement, such as picking up and placing a heavy sack of grain. In certain aspects, weighted objects used with an apparatus follow a "theme" of the apparatus. For example, an apparatus may be "themed" as a "factory workout". Thus, while the apparatus itself may have lights, sounds, and other decorations (e.g., thematic labels), this theme may be extended using the weighted objects, which for a "factory" theme may include weighted sacks or boxes.

Figure 2:
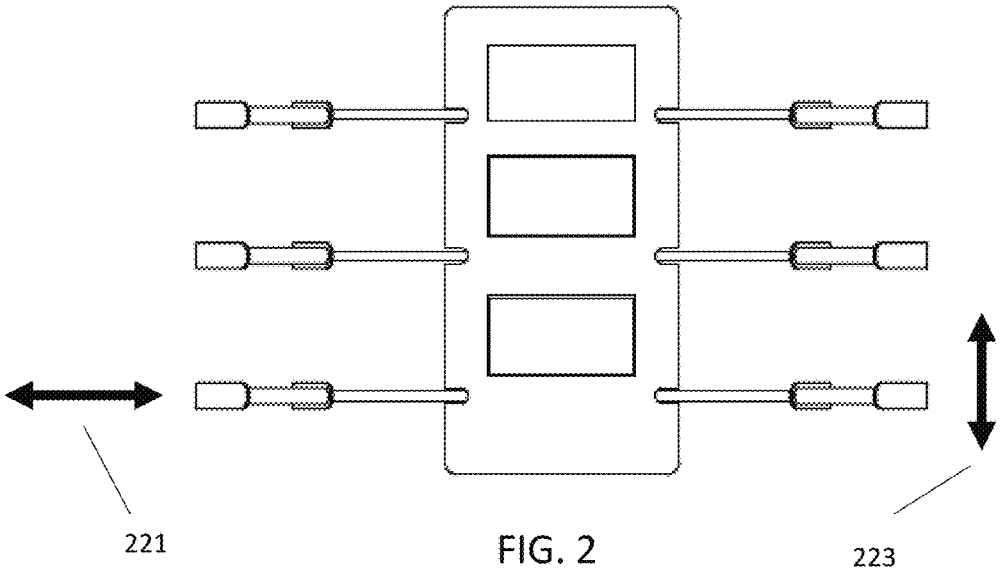
FIG. 2 shows a front view of the apparatus of FIG. 1, as well as certain exemplary directions along which the platforms may be moved.
Figure 3:
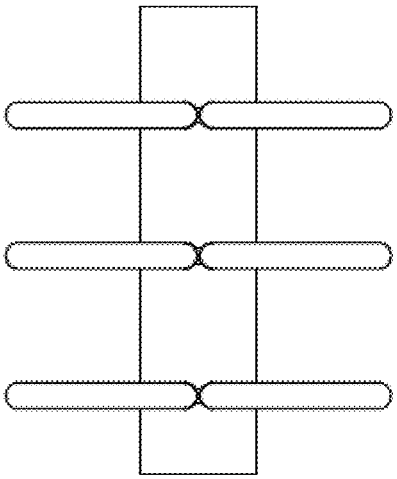
FIG. 3 shows a side view of the apparatus of FIG. 1.
Figure 4:
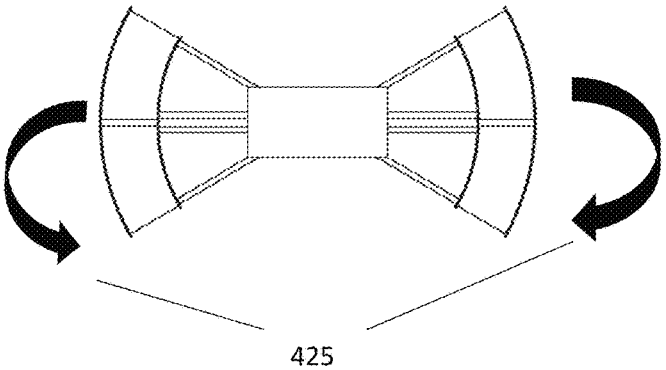
FIG. 4 shows a top view of the apparatus of FIG. 1, as well as certain exemplary directions along which the platforms may be moved.

In certain aspects, the positions of individual platforms and/or sets of opposing platforms may be adjusted. As shown in FIG. 2, the height 223 of one or more platforms relative to the base may be adjusted upwards or downwards. Similarly, the proximity 221 of one or more platforms relative to the base. As shown in FIG. 4, in certain aspects, the angle 425 of one or more platforms relative to the central body may be adjustable.

Figure 13:
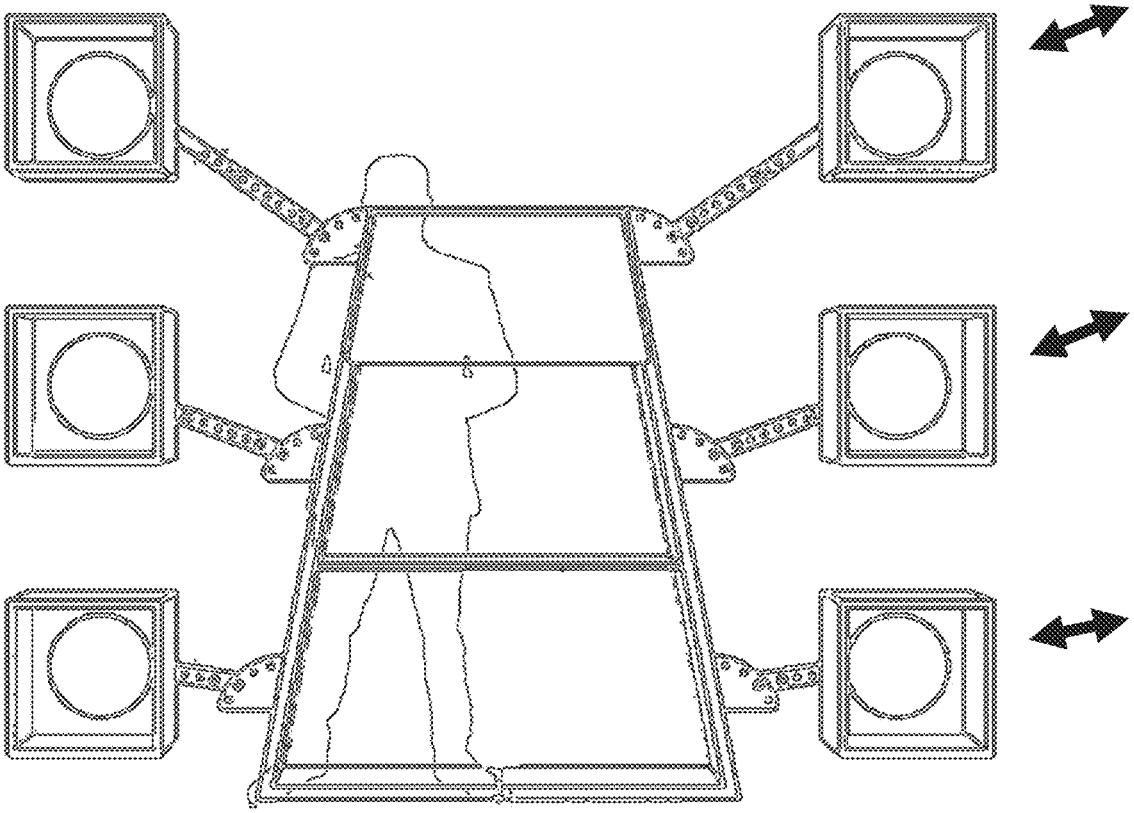
FIG. 13 shows a front view of the apparatus of FIG. 12, which shows its relative size when compared with an average adult human.
Figure 14:
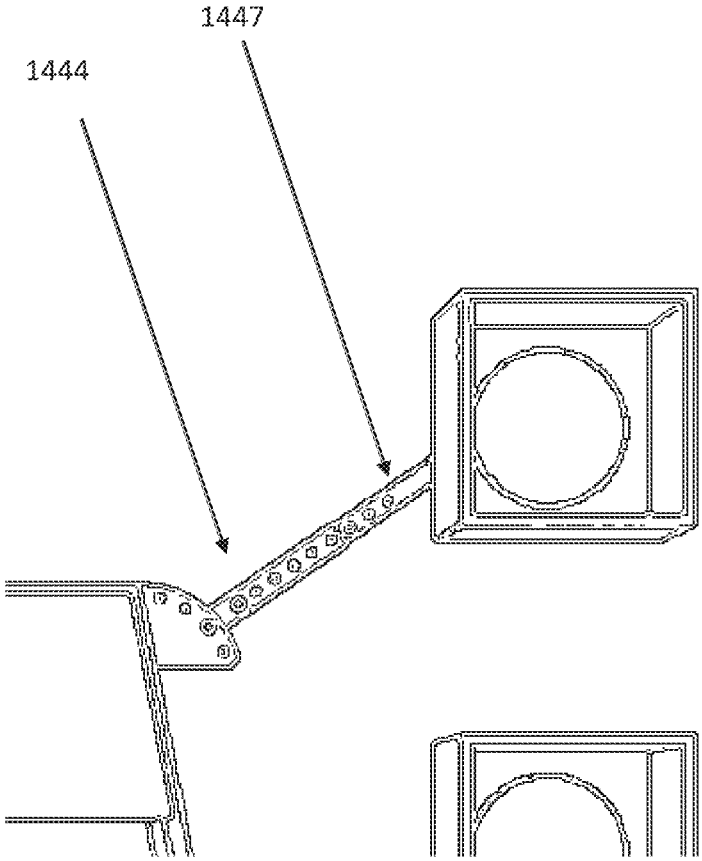
FIG. 14 shows closeup view of the connection between the central body and a platform/cubby in the apparatus of FIG. 12.
Figure 15:
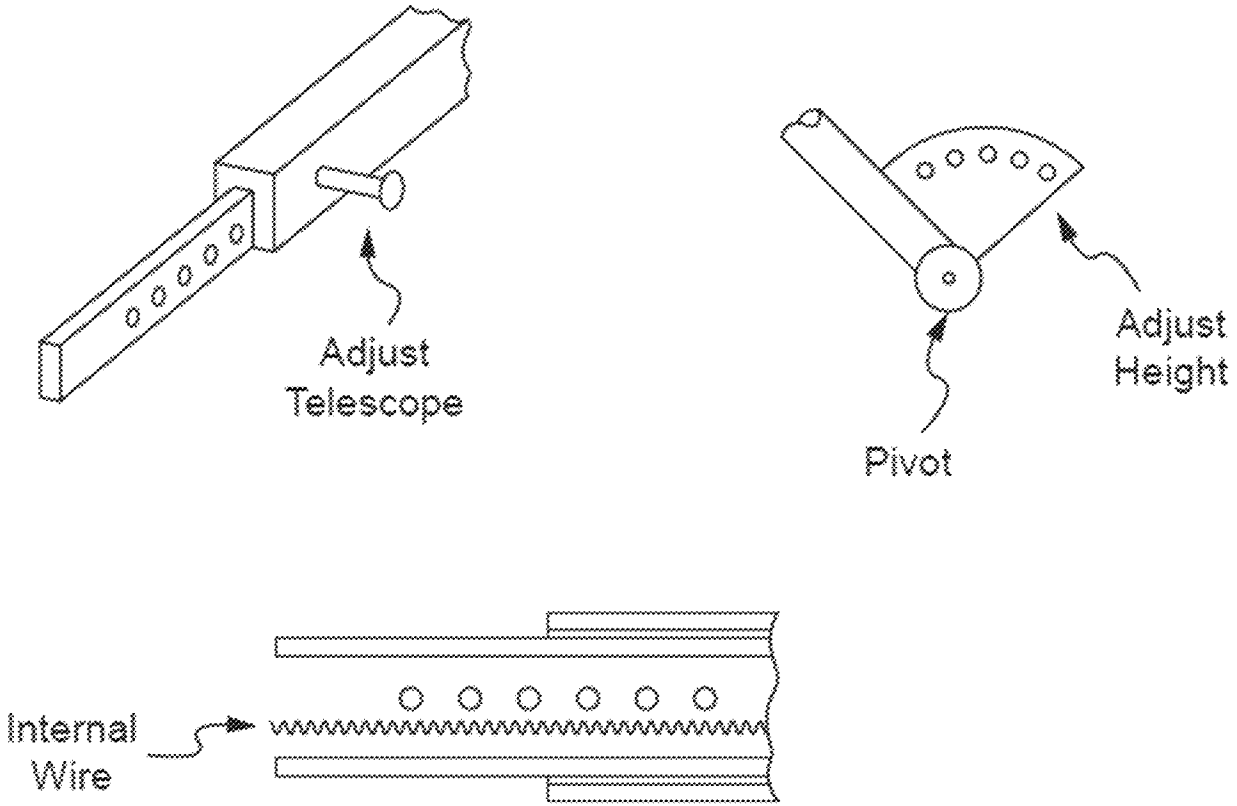
FIG. 15 details exemplary means for adjusting platforms or cubbies in certain apparatuses of the invention.

As shown in FIG. 13, adjusting the relative positions of the platforms provides a diverse range of potential movements—from large compound movements when platforms are separated to small, isolated movements when platforms are in close proximity to one another.

By incorporating this large range of adjustment, the apparatuses of the invention may be used for a wide variety of physical activities targeted at diverse sets of users and fitness goals. For example, the platforms/cubbies may be adjusted such that they are low and wide relative central body. In such a configuration, opposing sets of cubbies/platforms may be separated by a distance that requires a user to take a number of lateral steps to traverse. This configuration may allow a user to undertake a routine, for example, focused on quick, side-to-side lateral movements that are central to many sports. Similarly, cubbies may be adjusted such that the topmost are above a use's head, meaning a user will have to leap in order to place a weighted object in the cubby. In all such methods, pace, mass of weighted object, requirement to gently set objects, etc., may be adjusted to increase or decrease the intensity of a workout and/or based on the goals of the training.

The wide-range of adjustability allows the same machine that allows users to perform such fitness-oriented routines to also be used for less strenuous activities, such as those common in cognitive or physical therapy. Adjusting the telescoping arms to bring the cubbies closer to the central body and raising/lowering cubbies to within a person's range of motion reduces the need for a user to make large movements to place weighted objects between cubbies/platforms.

Figure 16A:
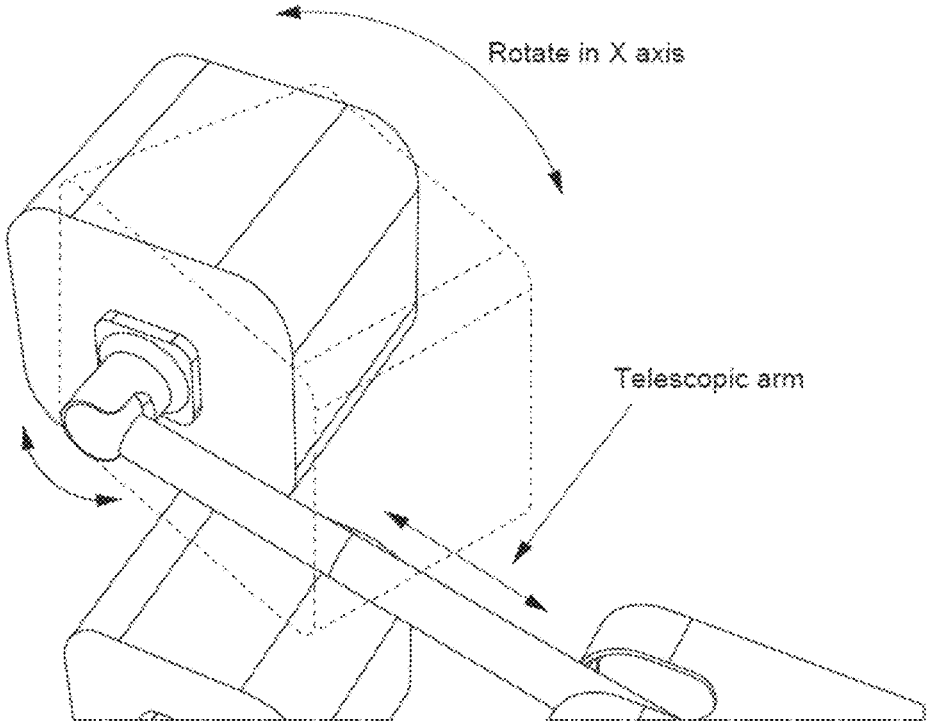
FIGS. 16A-16B details exemplary manners in which the arms and/or locations on which a weight is placed (e.g., platforms, cubbies, boxes, containers, etc.) can be adjusted or moved during use in certain apparatuses of the invention.
Figure 16B:
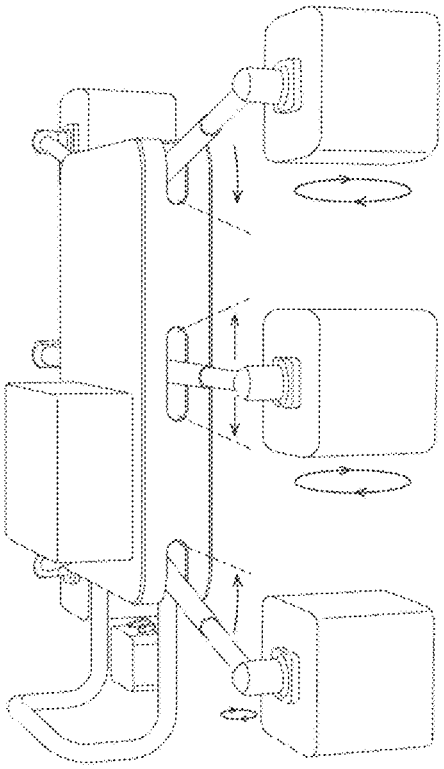

Any means of adjustment known in the art may be employed to adjust the platforms. As shown in FIGS. 14, 15, and 16A-16B adjustment may be accomplished using support beams that telescope/pivot/move, and are secured using a pin when the desired configuration is achieved. Alternatively or additionally, apparatuses of the invention may incorporate bi-directional hydraulic assemblies to move the platforms. As shown in FIGS. 16A-16B, apparatuses may be designed to include several adjustable elements, which ultimately provide nearly infinite adjustable configurations by which to use the apparatuses of the invention.

Figure 18:
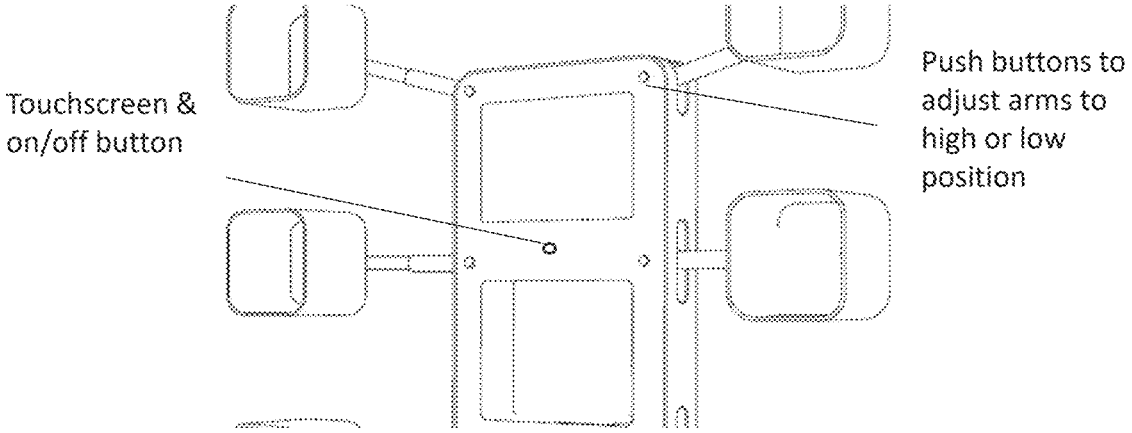
FIG. 18 provide a closeup view of the apparatus of FIG. 17 and highlighting its display, adjustable arms connecting the cubbies to the central body and the buttons used to control the movement of the adjustable arms.
Figure 19:
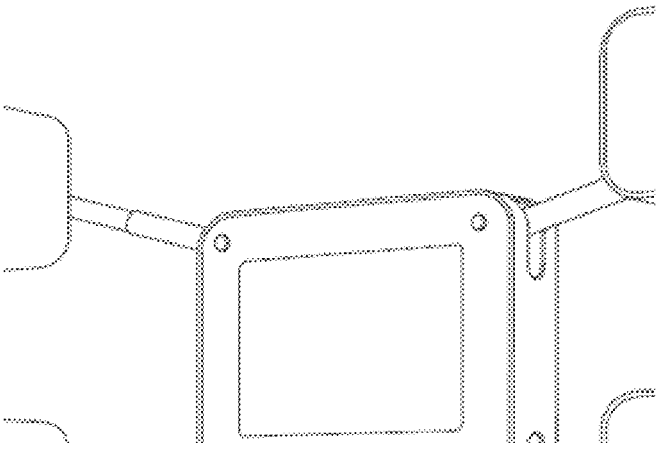
FIG. 19 shows a closeup view of the apparatus of FIG. 17 showing the attachment point of an arm with a central body.

As shown in FIGS. 18-19, in certain embodiments, the apparatus has telescoping arms that may be adjusted in height by pushing a button associated with each arm. Pushing the button may release a lock allowing the arm to traverse along a vertical axis. Advantageously, as shown, this configuration buries the adjustment mechanism within the central body such that a user cannot trap their fingers when adjusting an arm. In certain embodiments, the movement of the arm may be facilitated with a hydraulic or pneumatic assist and/or be counterweighted. This prevents an arm from collapsing when unlocked and helps a user when lifting an arm.

Figure 23:
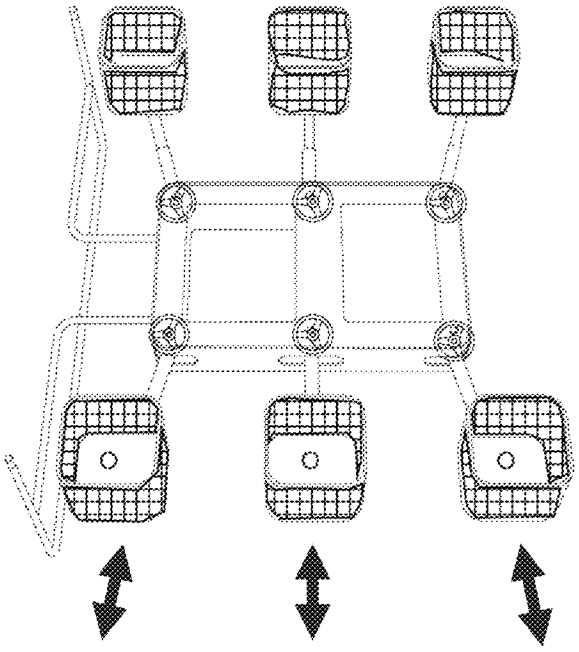
FIG. 23 shows an apparatus with alternative embodiments of the cubbies, visual indicators, and arm adjustments.
Figure 24:
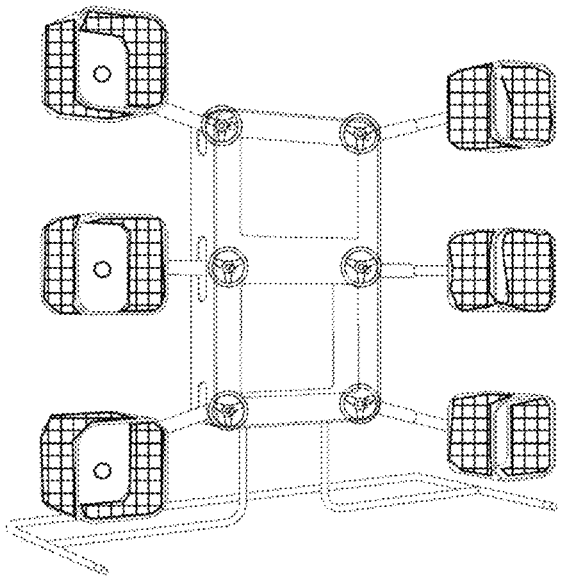
FIG. 24 provides a closeup view of the apparatus of FIG. 23
Figure 25:
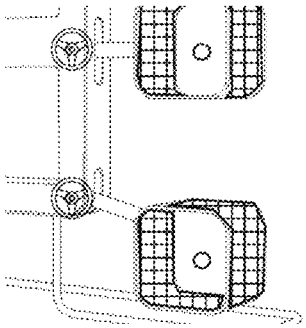
FIG. 25 provides a closeup view of the apparatus of FIG. 23

As shown in FIG. 23, in certain aspects, the telescoping direction of the arms may be controlled, for example, using a mechanical crank. Although shown with a crank, apparatuses of the invention may employ alternative mechanical and/or electromechanical means to move and actuate the arms to adjust the positions of the platforms/cubbies.

In certain aspects, the positions of the platforms are controlled using motors coupled to a central control module as described herein.

In certain aspects, a weighted object placed by a user on a part of the machine (e.g., a platform) will stay put until the user moves it elsewhere. In other cases, upon completion of placing a weighted item into position on a platform, the apparatus will move the item to another location, e.g., via a conveyor belt, slide, and/or other means as described herein.

Figure 5:
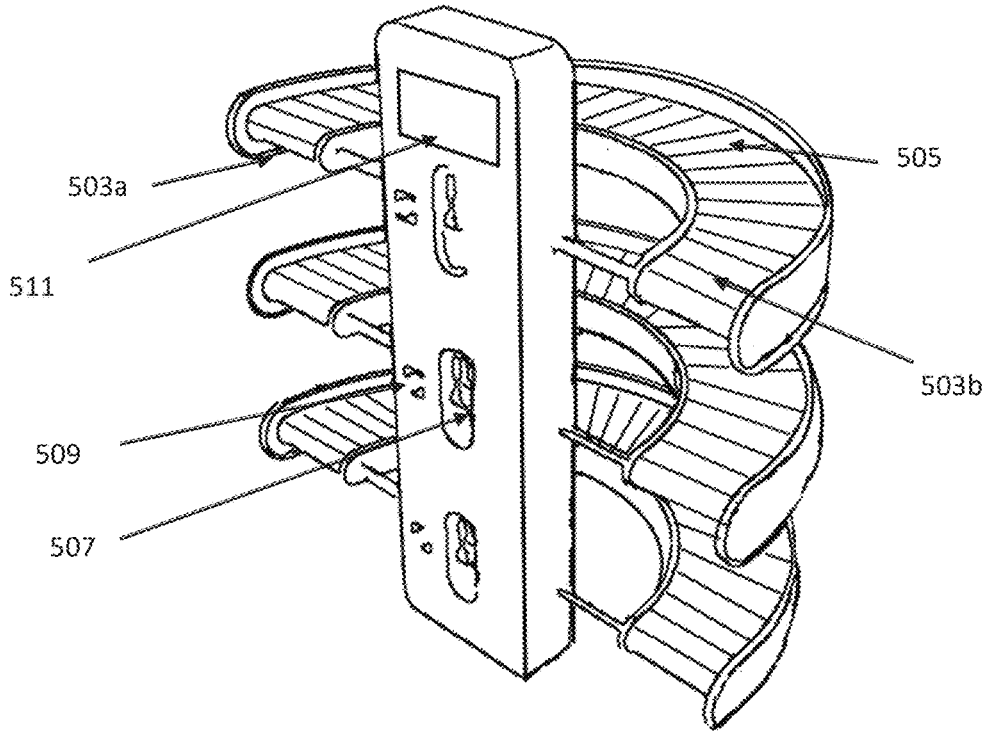
FIG. 5 shows a perspective view of another apparatus of the disclosure, which has sets of platforms connected with a conveyor that extends around the central body.
Figure 6:
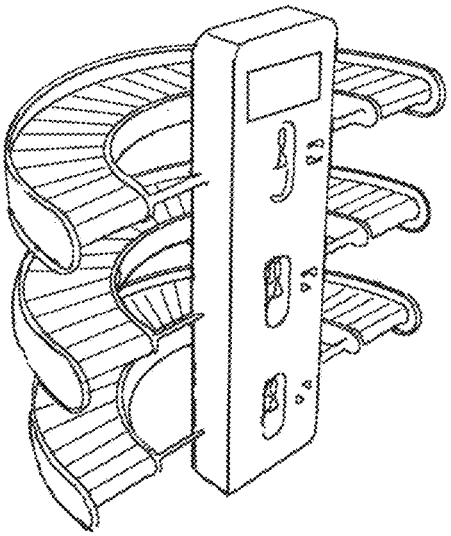
FIG. 6 shows perspective view of the apparatus of FIG. 5.
Figure 7:
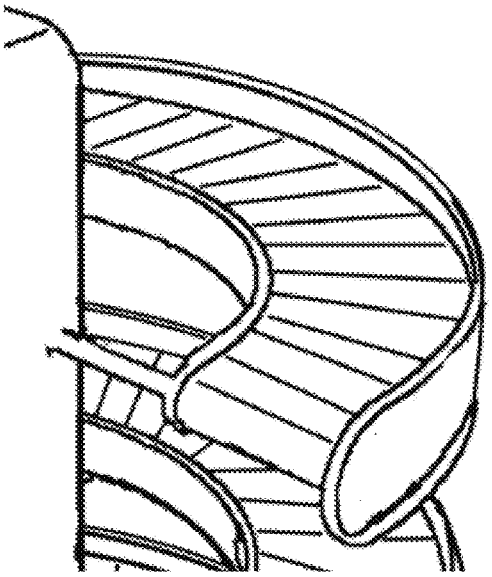
FIG. 7 shows a closeup view of the platform and conveyor of the apparatus of FIG. 5.

FIG. 5 shows an apparatus with opposing, connected platforms. As shown in FIG. 5, in certain aspects opposing platforms 503*a*, 503*b* may be connected to one another via a surface 505. A weight set on a first platform (e.g., 503*a*) may be moved by the apparatus to a connected platform (e.g., 503*b*) via the surface 505. Thus, for example, a user may pick up a weighted object from platform 503*a*, set it on platform 503*b*, at which point the apparatus moves it along the surface 505 to platform 503*a*. This allows for multiple repetitions of a movement using the same set of opposing platforms and a single or common set of weighted objects.

In certain aspects, the surface 505 is a low friction surface. By raising the height of a platform (e.g., 503*a*) relative to its opposing platform (e.g., 503*b*), when a weighted object is placed on the higher platform by the user, gravity coupled with the low friction surface will move the weight along the surface to the starting platform. The relative positions of the platform may be controlled, for example, using a control 507 on the central body. In certain aspects, the control is coupled to one or more motors that alter the position of the platforms.

Alternatively, the surface 505 may include a conveyor belt. Thus, a weight placed on one platform will travel along the conveyor belt/surface 505 and return to the original platform. The operation of the conveyor belt may be controlled using a dedicated control 509 for the conveyor belt and/or via an interface (such as a touchscreen) 511, as described herein.

Figure 8:
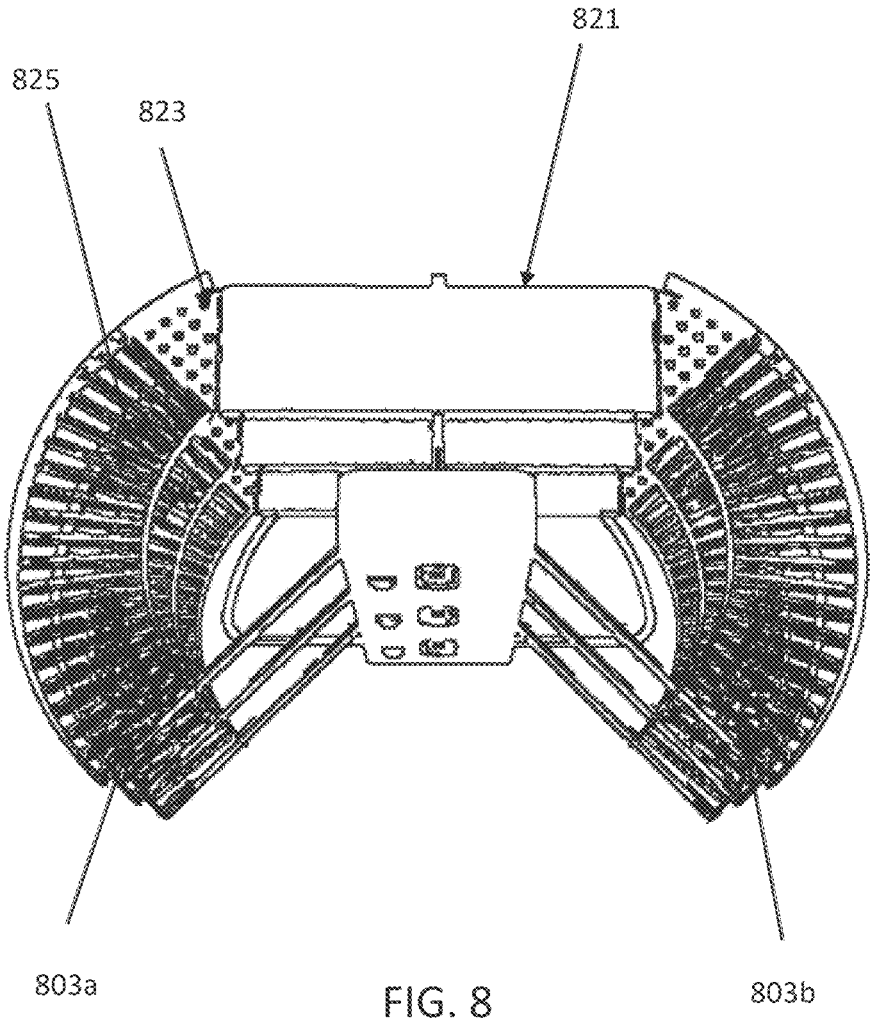
FIG. 8 shows a top-down view of an alternative apparatus of the disclosure, which has sets of platforms connected by rollers and a conveyor belt. In certain aspects, the conveyor belt may be removed, for example, to facilitate use by two concurrent users standing on opposite sides of the apparatus.
Figure 9:
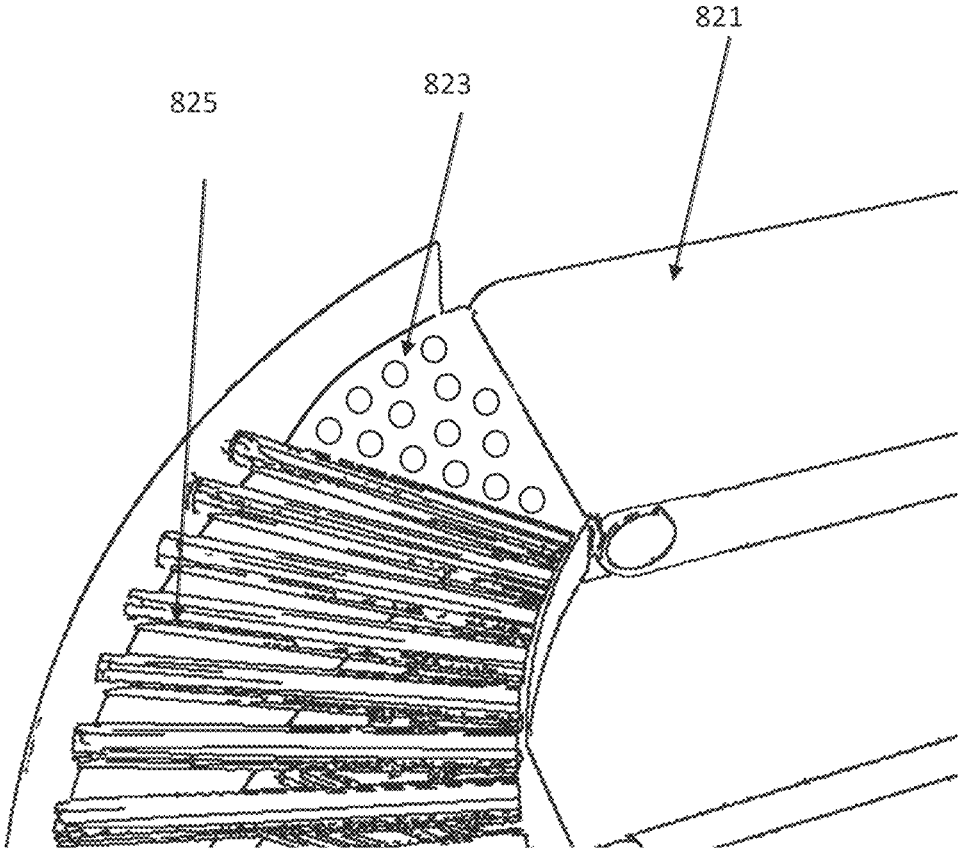
FIG. 9 shows a closeup view of the apparatus of FIG. 8, which shows two sets of rollers and a conveyor that move weights between platforms of the apparatus.
Figure 10:
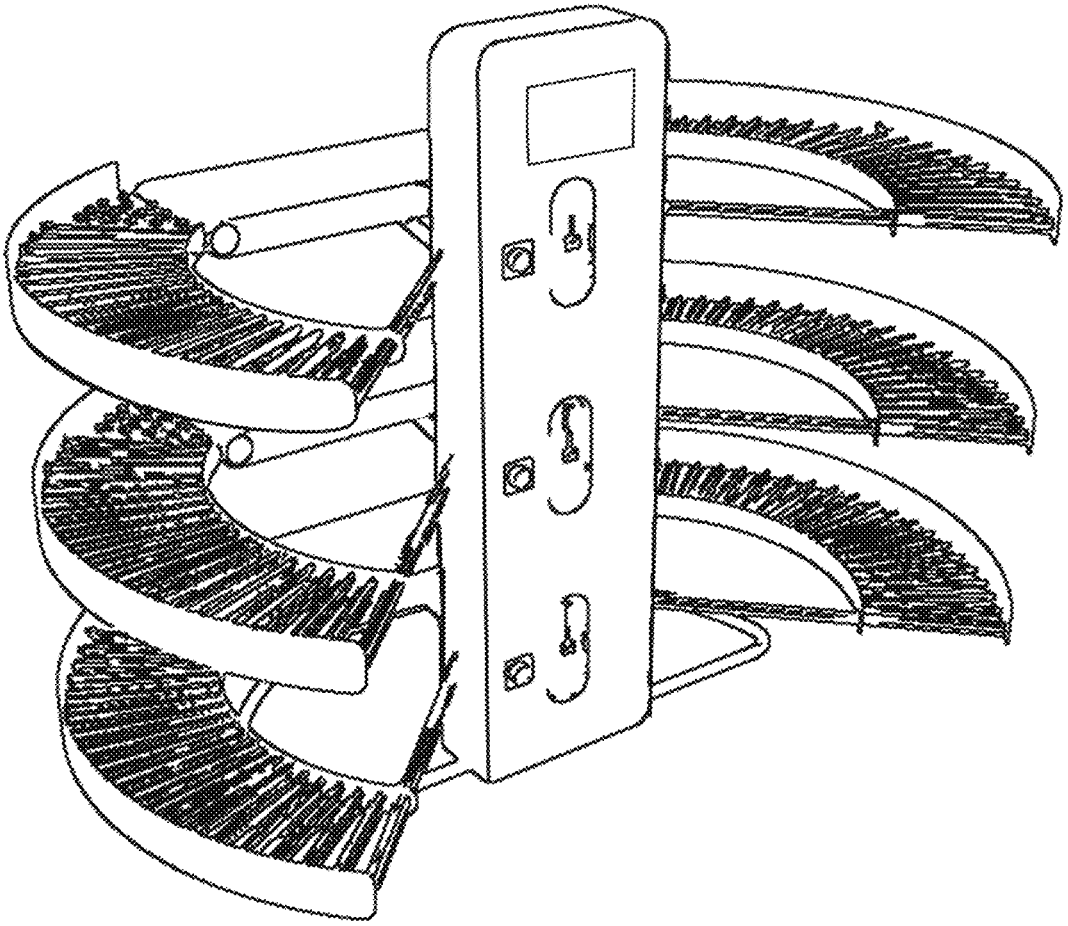
FIG. 10 shows perspective view of the apparatus of FIG. 8.

As shown in FIGS. 8 and 9, in certain aspects opposing platforms 803*a/b* may wrap around a central support body. Pairs of platforms may be connected by a surface, which may include one or more of rollers 825, bearings 823 and/or conveyor 821 belts that move weighted objects between connected platforms in either direction and at varying speeds.

In certain aspects, the conveyor belts 821 may be removed such that the apparatus is usable by two users simultaneously. The users may face one another with the apparatus between. This may allow, for example, certain routines that employ a competitive or cooperative aspect.

Figure 11A:
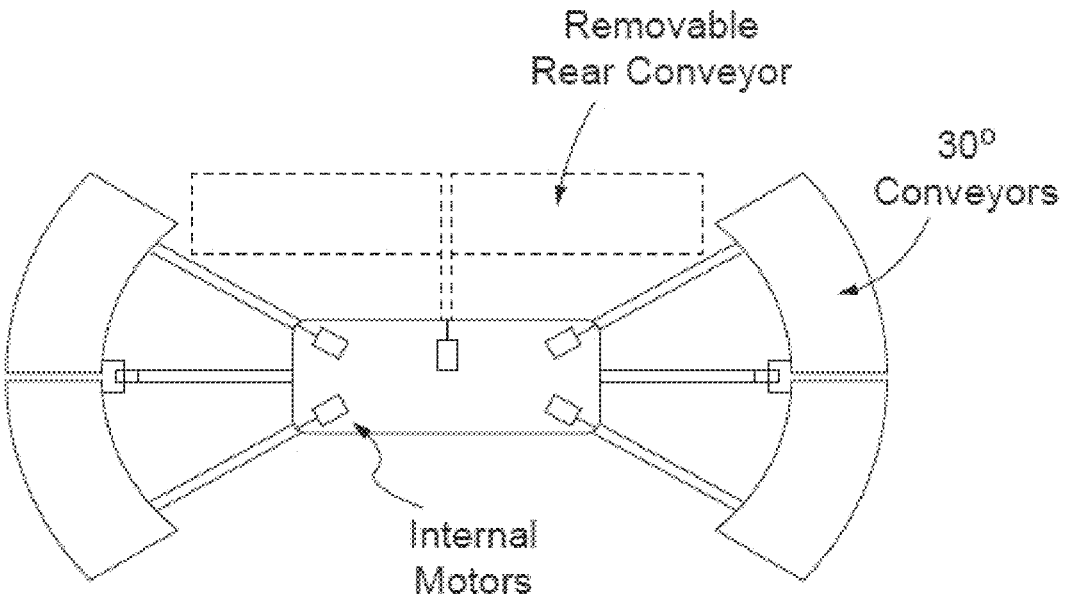
FIG. 11A shows an apparatus of the disclosure with sensors positioned thereon.
Figure 11B:
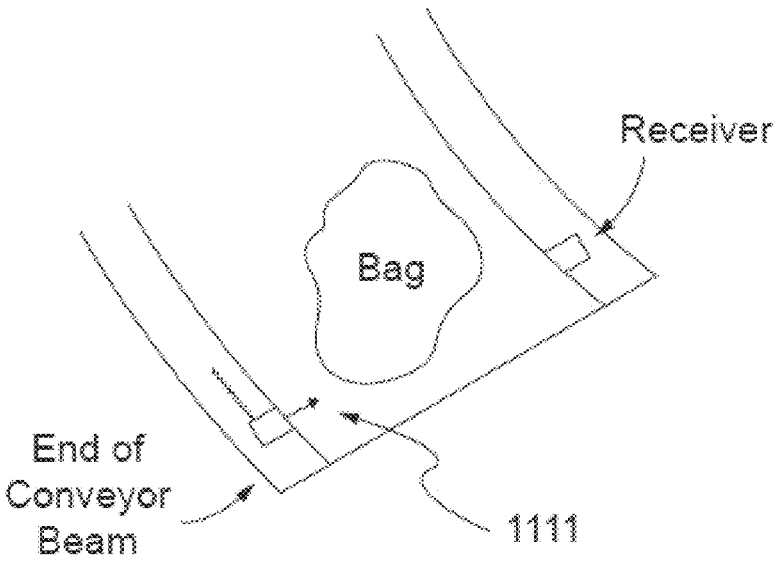
FIG. 11B shows a closeup view of the apparatus in FIG. 11A, showing where a weighted object used with the apparatus passes by a sensor.

As shown in FIGS. 11A-11B, in certain aspects, apparatuses of the invention may include one or more sensors 1111 disposed on the platforms, which are coupled to a central control module. Sensors may, for example, detect when a weighted object is placed or removed from a particular platform. Such sensors may detect the presence and/or position of a weighted object by mass and/or by an identifier, such as a radio frequency identification (RFID) chip or Bluetooth transmitter embedded in the object. Advantageously, by using an identifier, such as an RFID chip, weights (including those of equal masses) may be independently identified by an apparatus of the invention. This allows, for example, the apparatus to discriminate between objects off different appearance (e.g., colors), even if they have similar masses.

In certain aspects, apparatuses of the invention include one or more sensors that detect when a weighted object is positioned on a platform through movement of a weighted object between platforms, e.g., via a conveyor belt. Such sensors include, for example as shown in the closeup view provided in FIG. 11B, a beam of electromagnetic radiation (e.g., a laser or beam of infrared light) that is interrupted when a weight is positioned between sensors disposed on the sides of a platform. Interrupting the beam may, for example, cause a conveyor belt to stop or start depending on the desired location of a weighted object in accordance with an ongoing exercise program.

In certain aspects, each platform/cubby includes one or more sensors that detect the force at which an object is set down by a user. Such sensors may, for example, detect changes in weight and/or movement of the platform in response to a weighted object's deposit. Sensors that detect movement may include, for example, accelerometers. By detecting a high force or large amount of movement, in certain aspects, an apparatus of the invention may determine whether a user dropped a weighted object (e.g., due to fatigue or poor form) or placed the object on a platform in a controlled and coordinated manner, which may be indicative of proper technique. Such sensors may provide a signal to a central control module, which in turn, causes a signal to be displayed to a user. The displayed signal may, for example, indicate that a user dropped a weight with too much force.

Figure 12:
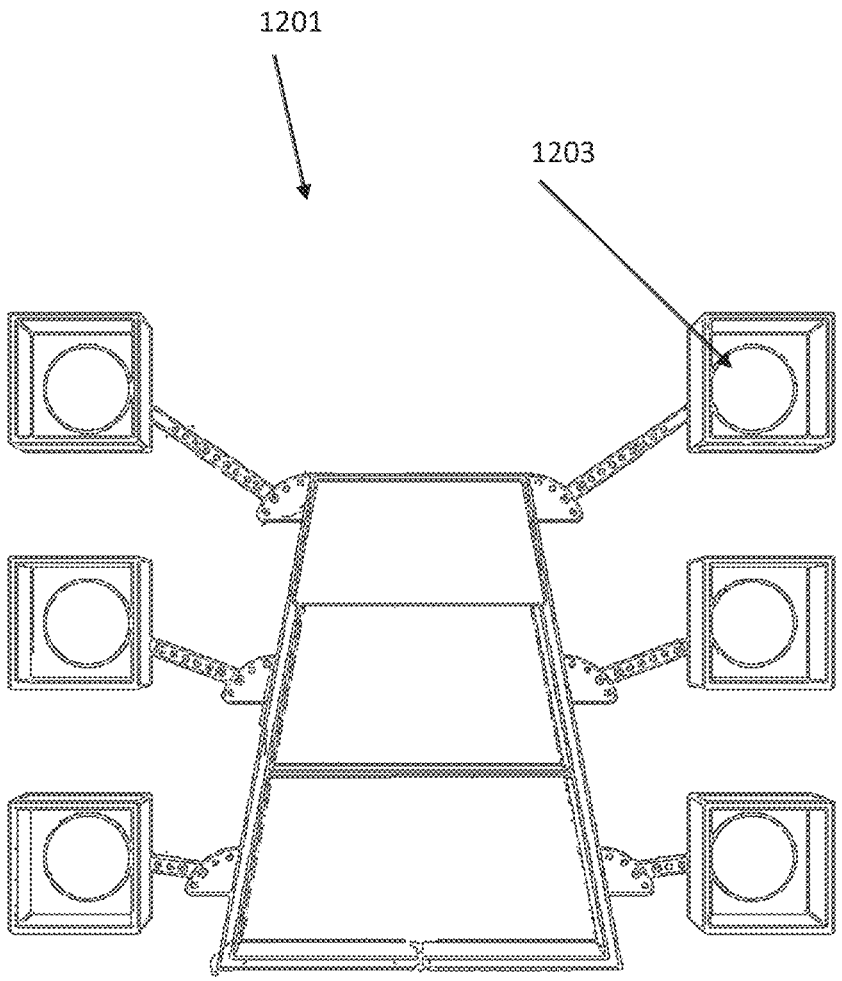
FIG. 12 shows a perspective view of an apparatus of the disclosure that uses cubbies as the platforms.

As shown in FIG. 12, the platforms may possess a number of different configurations. In FIG. 12, the platforms are configured as cubbies, boxes, and/or any other partially enclosed area into which a weighted object is deposited.

As shown in FIG. 12, the platforms may be configured as a cubby or box with a defined opening facing a user. As shown in FIG. 23, the cubby or box may be made from any material such that it adequately supports the weight of an object placed within it. In FIG. 23, the cubby is made, in part, using a meshed material. Advantageously, this allows a user to quickly determine whether a cubby contains an object from multiple angles.

Figure 17:
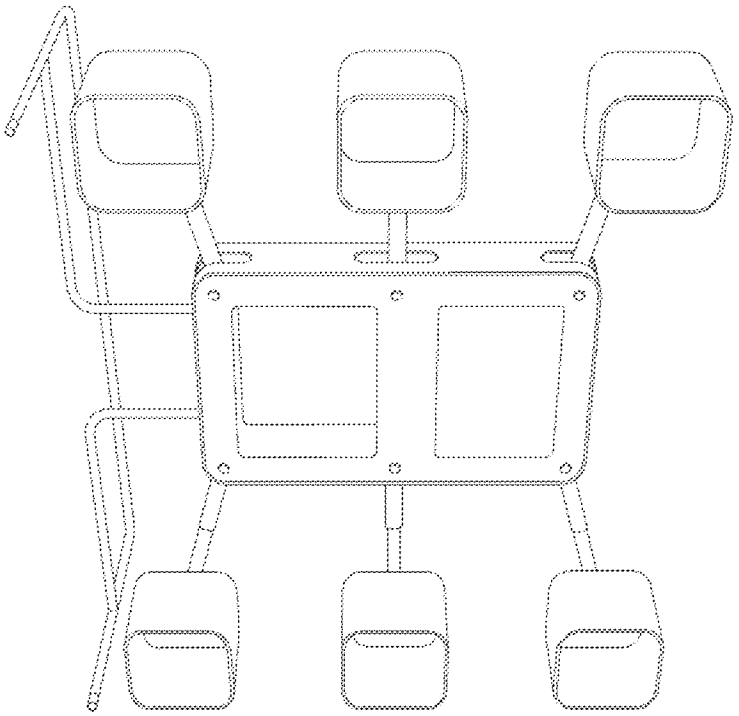
FIG. 17 provides a perspective view of an additional apparatus with cubbies.
Figure 26:
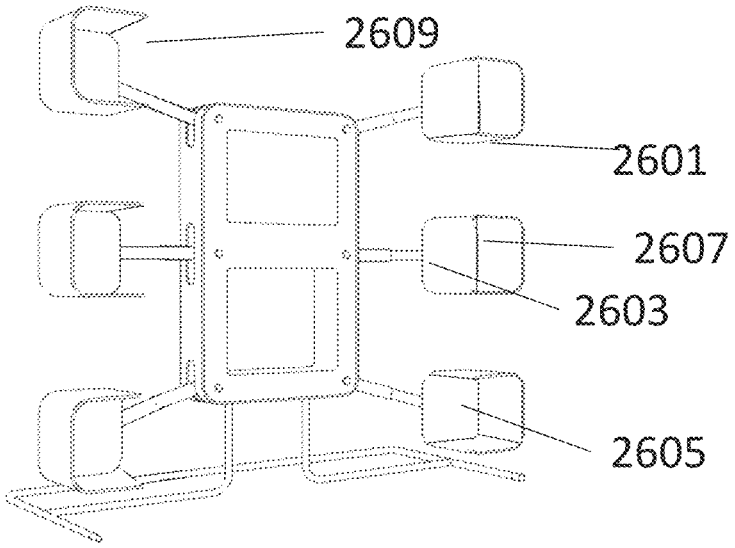
FIG. 26 shows an apparatus with alternative embodiments of the cubbies and visual indicators.
Figure 27:
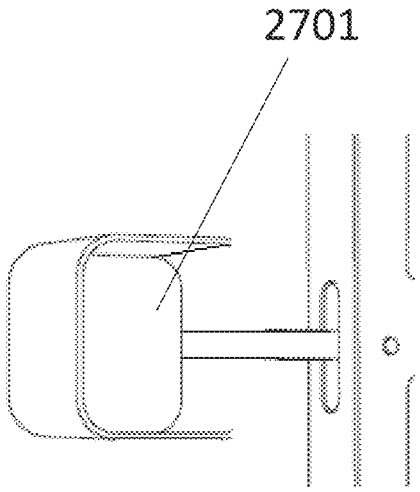
FIG. 27 provides a closeup view of the apparatus of FIG. 26.
Figure 28:
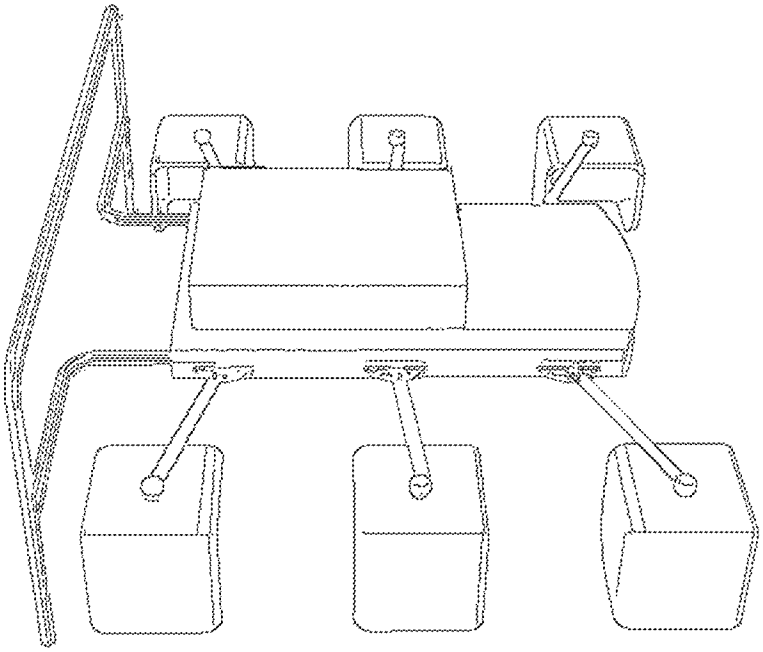
FIG. 28 shows a back view of the apparatus of FIG. 16.

FIG. 17 provides another embodiment in which the cubby or box is configured as a rounded box, again with a defined opening facing the user. As shown in the apparatus provided in FIG. 26, the platforms/cubbies 2601 may take on any shape or size, so long as they can adequately hold a weighted object during use. In FIG. 26, the platforms 2601 include surfaces partially enclosing the platforms. As shown, the surfaces enclose the platforms such that each has a top 2607 enclosing surface, a back 2603 enclosing surface, and a side enclosing surface 2605. Consequently, each platform is not only open in a direction facing directly towards the user, but along several axis within is user's reach 2609, which may find particular utility with users that have limited mobility and/or dexterity. In certain aspects, surfaces enclosing a side or area of a platform are only partial surfaces in that they form only a lip or ridge to prevent an object from rolling off the platform during use. As shown in FIG. 27, platforms/cubbies of the invention may include a lip, rail, ridge, or other protuberance that prevents an object from rolling or slipping away after deposition, but provides minimal interference to a person placing a weighted object in or on a platform of the device. In certain aspects, such physical means for blocking the weighted object from falling off the platform can be replaced as needed to account for different types of weighted objects used with the apparatus.

In certain aspects, a platform of an apparatus of the invention is formed with a shaped, contoured bottom, pocket, or the like, such that a deposited object will stay in place when set in or on the platform. In such embodiments, enclosing surfaces surrounding the platform may be unnecessary, as the platform itself acts to contain the weighted object from unwanted movement. Alternatively, in certain aspects, the platform or cubby is otherwise replaced by a deformable material, e.g., netting or rope, which acts to shape to or otherwise hold a placed object.

As shown in the device exemplified in FIG. 12, platforms/cubbies may have visual indicators 1203, such as a colors or lights, by which they may be independently identified. Thus, a user may be prompted, e.g., through instructions provided by an interface as described, to pickup/deposit weighted objects with references to specific platforms. This adds mental and accuracy components to a program, which may be especially beneficial in the context of gamified programs or those designed to enhance neural function.

In preferred aspects, the visual indicator is a light (e.g., and LED panel) 1203 disposed in or on each platform which faces a user operating the apparatus. As shown in FIG. 23, lights may take on different sizes as desired. In FIG. 23, because mesh sides are used to form the cubbies, allowing for visibility from more angles, a smaller visual indicator may be employed.

As shown in the apparatus of FIG. 26, the visual indicator 2601 may take any different shape, so long as it is adequately visible to a user. The cubbies in the apparatus of FIG. 26 are open from multiple sides. Therefore, a narrow visual indicator 2601 suffices.

Figure 22:
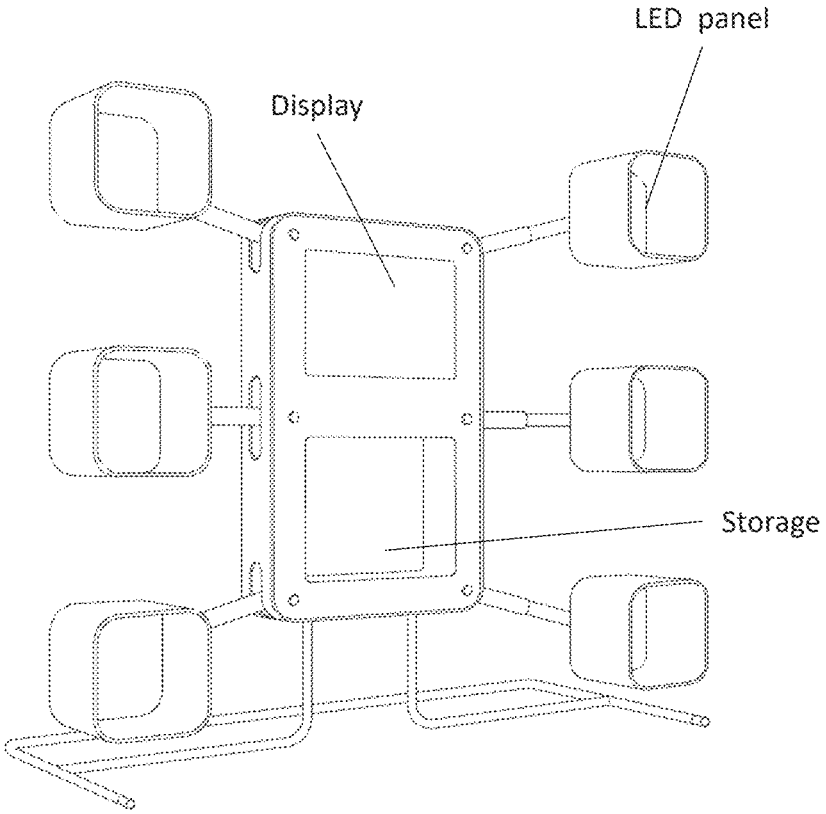
FIG. 22 shows the apparatus of FIG. 17 with illuminated indicators (LED panels) inside each cubby.

As shown in the apparatus of FIG. 22, in certain aspects, the visual indicator may be disposed across an entire surface of a cubby/platform. This assures that the apparatus displays a vibrant and clear visual signal to a user.

Figure 29:
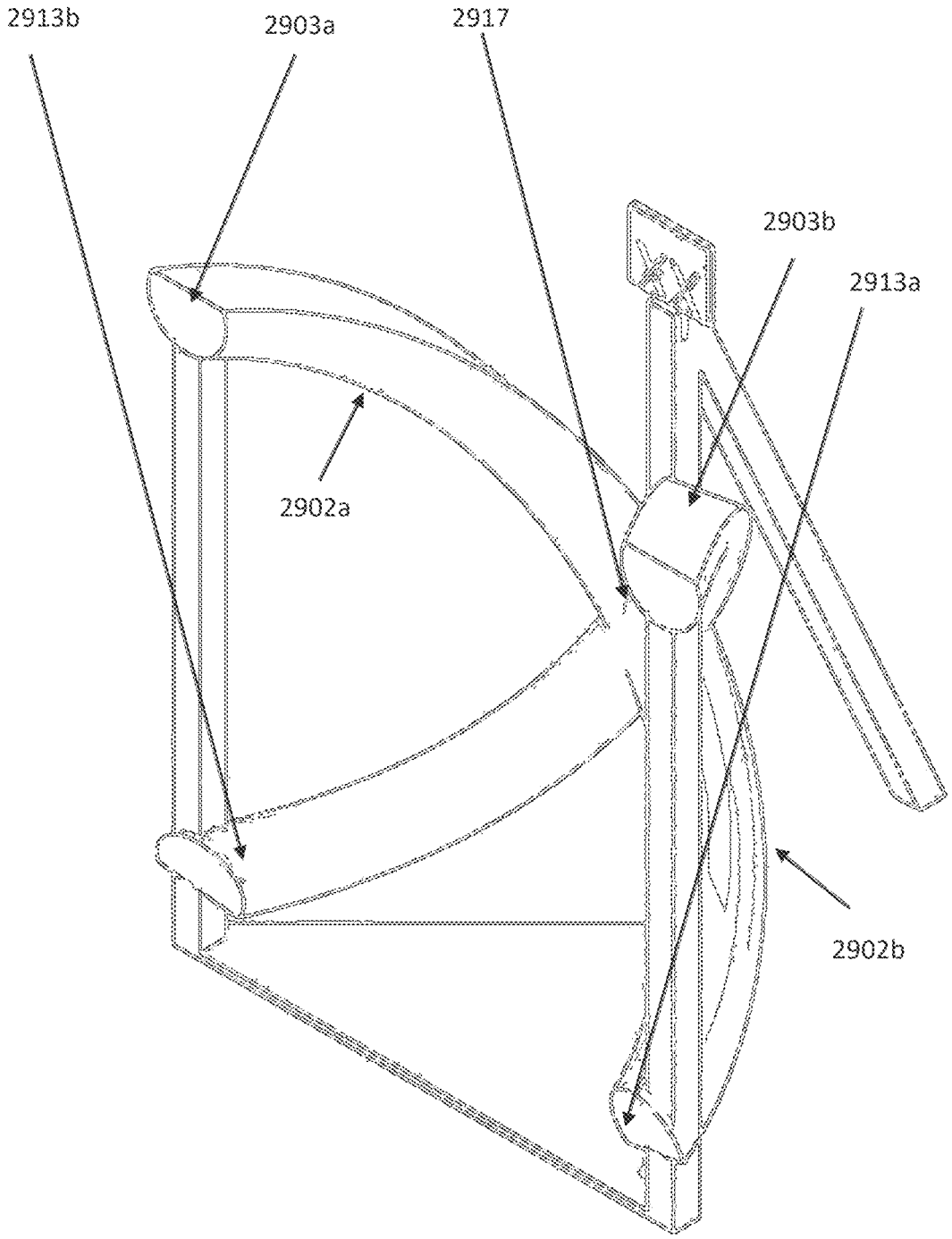
FIG. 29 shows an apparatus of the invention that uses tubes or slides rather than platforms.

As shown in FIG. 29, the present invention also provides an exercise apparatus comprising a plurality of tubes or slides 2902*a/b*. Each tube/slide includes an upper opening 2903*a/b* and lower opening 2913*a/b*. When in operation, a user to lifts a weighted object from a lower opening of one of the tubes and deposits it in the upper opening of one of the tubes. As a result, the weighted object slides to a lower opening in of one of the tubes. In certain aspects, the tubes 2902*a/b* intersect 2917 one another between their respective upper and lower openings. The intersection 2917 of the tubes may include a flap that directs the weighted object deposited into an upper opening of a tube to slide into the lower opening of a desired tube. Thus, for example, an object deposited into upper opening 2903*a* may end up in opening 2913*a* or 2913*b* depending on the direction of the flap.

Figure 20:
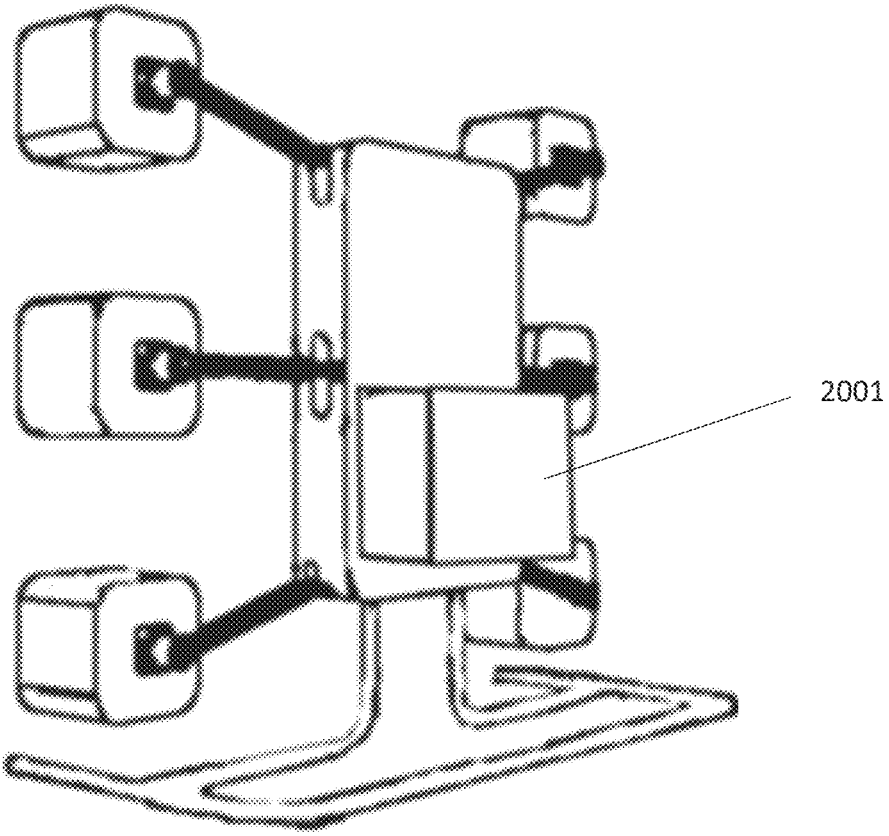
FIG. 20 shows a back view of the apparatus of FIG. 17
Figure 21:
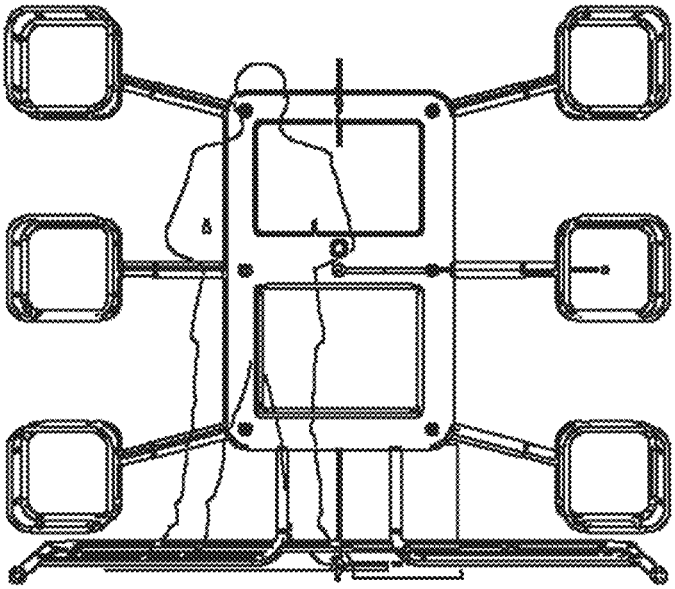
FIG. 21 shows the apparatus of FIG. 17 relative to an adult user.

As shown in FIG. 20, in certain aspects, the apparatuses of the disclosure are set upon the ground for use. The apparatus may be supported by a base 2001. In certain aspects, the base of an apparatus may be removed such that it is mounted on a wall or structure. The apparatus may have a shelf or compartment 2001 that is removable such that the central body sits flush with a wall.

In certain aspects, the apparatus of the invention includes a control module that comprises one or more processors and memory. The control module may be coupled to an interface. The memory may be configured to store programmed instructions of a programmed workout that, when executed by control module, cause the one or more processors to provide a user with instructions for performing the workout e.g., instructing a user to lift a weighted object from a location on the machine. Preferably, the instructions are provided via the interface to the user. In certain aspects, the control module is coupled to one or more sensors that track the location of weighted objects around the apparatus. Based on signals from these sensors, the control module may determine whether a user has successfully performed an instructed action, and may adjust the workout based on predetermined criteria in response to the user's performance. For example, the control module may, in response to a user's actions or inputs, automatically adjust the speed or intervals of a workout, rest periods, recovery periods, cool down periods, the locations from which a user picks up and deposits weighted objects. The control module may also instruct a user to use weighted objects of greater or less mass. In certain aspects, the programmed instructions of the programmed workout may provide a user with correct techniques for lifting and depositing the weighted objects. In some embodiments, the instructions may further instruct the user on performing a specific exercise with the one or more weighted objects and/or intersperse, for example body weight exercises into the workout.

In some embodiments, the lifting instructions may further instruct the user on a number of repetitions to perform, and may provide a countdown of, for example, repetitions remaining/performed.

In some embodiments, the instructions may include one or more of written words, images, lights, verbal cues, and the like. In some embodiments, the apparatus includes an interface that includes a display on the central body. The apparatus may include one or more inputs (e.g., buttons or a touch screen) for interacting with the interface. In some embodiments, the apparatus may further include a speaker, and the speaker may be configured to audibly broadcast at least a portion of the instructions.

In some embodiments, the memory may store a library of programmed workouts from which the programmed workout that may be selected by the user, and the library of programmed workouts may be downloadable to the memory from a remote network location over a Wi-Fi network connection.

In certain aspects, the apparatuses of the invention employ signal indicators in or on the platform, such as lights, to identify particular platforms/cubbies/tubes. As shown in FIG. 22, the apparatus may use different colored lights as indicators in each platform. This allows the apparatus to provide an instruction to a user using a quickly discernible instructions, such as a color, rather than the position of a particular cubby. Thus, for example, the device may instruct a user to pick up a weighted object from GREEN. The green light in the bottom right cubby indicates to the user that this is the cubby from which to pick up a weight. Once the user picks up the weight, the apparatus may then provide an additional instruction to the user that specifies the cubby into which the user should deposit the weight. Thus, for example, after the user picked up the object from the green cubby, the apparatus may instruct the user to deposit it in BLUE, in which case the user will set it into the cubby lit with a blue light.

In certain aspects, an apparatus may use a consistent visual indicator for a particular cubby. Thus, for example, in FIG. 22, the lower right cubby would always illuminate green. Alternatively, in certain aspects, each visual indicator is capable of producing different colored light. Thus, between rounds or repetitions, the indicators will change between cubbies. Thus, for example, what was the blue box would change to a different color or stop illuminating altogether. In order to set a weight in a correct cubby after such a change, a user will have to employ cognitive reasoning to determine the new identities of the cubbies. The visual indicators and/or display may also be used to signal to a user whether a user set a weight down in a manner indicative of poor form or too much weight, e.g., with too much force or movement. The indicators and/or display may also provide an indication to a user that they set/picked up a weighted object from the incorrect location.

In certain aspects, the programmed workout may be a gamified, i.e., a workout that creates an experience similar to game or competition. For example, the control module may instruct a user to move weighted objects as fast as they can for a timed interval. The control module may record, via sensors, a user's speed and/or accuracy (e.g., picking up and setting down weights from the correct platforms) when performing the workout. In certain aspects, gamification includes workouts in which users compete or cooperatively perform a workout. This may include using the same machine and/or via a wired or wireless connection to other machines. In certain aspects, the interface includes a scoreboard visible to users of the apparatus.

In certain aspects, a display may be used to provide a score to a user. A score may include or consider, for example:

- NUMBER OF WEIGHTS: the number of weighted objects picked up and set down by a user.
- AMOUNT OF WEIGHT: the total amount in mass/weight of the total number of weighted objects moved.
- CALORIES BURNED: calories burned during a routine or rep.
- ACCURACY: the number of weighted objects correctly picked up from a specified platform and deposited on a specified platform.
- MISSES: the number of weighted objects picked up from or set down on a platform other than that specified.
- FORM: tracks, for example, whether a user set down a weight with too much force, indicating poor form in completing a repetition.
- RANGE OF MOTION: when a user is operating the apparatus from a fixed position, the range of motion may be determined by the locations (platforms) from which a user is able to pick up and/or deposit weighted objects.
- MOVEMENT DIFFICULTY: consideration of the amount of weight, relative locations of the platforms, and the movement employed to move a weight between platforms.
- REFLEX TIME: the amount of time that elapses between an instruction and completion of a rep (e.g., picking up/setting down a weighted object).
- COGNITIVE SCORE: a score based on a user's mental acuity in completing a routine.
- PHYSICAL SCORE: a score based on a user's physical actions during a routine.
- COMPOSITE SCORE: a score that combines a cognitive and physical score.
- IMPROVEMENT SCORE: score based on longitudinal assessment of routines performed by a user.

Scores may be calculated during a program or a routine and/or at its completion. Scores may be tracked or calculated relative to elapsed time during a routine or repetition. For example, NUMBER OF WEIGHTS/TIME=NUMBER OF WEIGHTS SCORE. In certain aspects, one or more scores are used in conjunction with, or to modify, another score. Thus, for example:

NUMBER OF WEIGHTS SCORE=NUMBER OF WEIGHTS/TIME

ACCURACY SCORE=MISSES/NUMBER OF WEIGHTS

ROUTINE SCORE=[NUMBER OF WEIGHTS SCORE]*[ACCURACY SCORE]

In certain aspects, an apparatus may provide a score indicative of a user's mental acuity during a routine. For example,

COGNITIVE SCORE=[REFLEX TIIVIE]*[ACCURACY]*[NUMBER OF WEIGHTS]

In certain aspects, the apparatus displays cognitive- and physical-based scores separately. In certain aspects, the apparatus combines cognitive- and physical-based scores into a composite score.

Scores, including running scores, may be displayed to a user of an apparatus and/or users of another apparatus in the case of networked machines. Scores may be tracked for individual users over time to provide show progress and improvement. In certain aspects, an apparatus may be used in a competitive mode, such that user scores are compared to determine a winner. In certain aspects, an apparatus may be used in a cooperative mode such that user scores are compiled into a combined score.

In certain aspects, scores for individuals may be modified to compensate or normalize for physical or cognitive performance differences between the individuals. Metrics such as total weight are specific to an individual user and cannot readily be compare individuals with disparate physical or cognitive capabilities. However, using a normalized score system based on select variables, such as gender, age, body weight, past performance, cognitive ability, and the like, the exercises can be gamified with respect to users between different demographic groups. Such scores may be "gamified" scores, in that they do not include any specific units of measurement, though they may be based on the metrics of an individual's performance in completing a routine. Such "gamified" scores may find particular utility where an apparatus is used for primarily entertainment purposes, such as in an arcade. Thus, in certain circumstances, an apparatus may include a coin slot, bill slot, and/or card reader to provide a means of payment.

In certain aspects, an apparatus of the invention may include an "attraction" and/or "demonstration" mode. Apparatuses of the invention may be configured to activate an "attraction"/"demonstration" mode after a certain period of non-use and/or in response to a potential user walking by the machine. An apparatus of the invention may use one or more dedicated sensors or use sensors already used to facilitate a workout to detect a person passing by the machine.

Generally, "attraction" mode is used to draw potential users' interest to the machine. This may include lights, sounds, and/or movements of any adjustable components of the apparatus. The "attraction" mode may help associate a particular "theme", as described herein, of a device for a user. A "demonstration" mode may activate like the "attraction" mode, but while attracting a user, may also show how the apparatus functions when in use. The "attraction" and "demonstration" mode are similar to the behavior of many free-standing arcade machines. However, in the present case, the "attraction" and "demonstration" modes are designed to encourage users to perform a workout rather than merely play an arcade game.

In certain aspects, the programmed workout includes cognitive rehabilitation therapy, in which a user is prompted to lift a specific weighted object (e.g., from a particular platform or of a particular color) and deposit it at a specified location. This may include, for example, a prompt that a weight should be picked up from a designated platform (e.g., using an indicator light or a designation such as a color) and deposited on another designated platform. Such instructions necessitate cognitive involvement, and may help improve cognitive function as part of a cognitive rehabilitation therapy.

Advantageously, because the apparatuses of the invention use free-standing weighted objects, different objects may be used depending on a user's physical or mental capabilities. For example, may users undergoing rehabilitation may have reduced strength. Thus, lightly weighted objects may be used with an apparatus. As a user gains strength, the same apparatus may be used with weighted objects of increasing mass. Similarly, many users undergoing therapy have reduced grip strength and/or dexterity. Such users may benefit from the use of easily grasped weighted objects, such as a beanbag, which are usable by the devices of the invention.

Combining physical and cognitive actions in a routine using an apparatus of the invention may provide psychological benefits to a user beyond physical or cognitive actions alone. An apparatus of the invention may be used in routines that combine physical activity with cognitive exercises in a synergistic manner. The synergistic benefits of physical activity augments the efficacy of the cognitive exercise. Further, it has been shown that combining cognitive and physical exercises helps prevent users from quitting a routine. Combined cognitive and physical routines find particular use in rehabilitation that may require physical and mental recuperation.

In certain aspects, cognitive activities using an apparatus of the invention include techniques that test and/or train the cognitive abilities, including a user's attention, memory, processing speed, logical reasoning, spatial reasoning, and cognitive executive functions. Routines of the invention that instruct users to pick up/set down weighted objects may take several formats, and thus may require a user extrapolate or interpolate patterns (e.g., pick up/set down a series of weights by memory after being presented with a series of instructions) to identify missing elements, matching exercises of examining a multitude of elements and identifying common features, memorizing a series, logic puzzles, and the like.

For example, using the device exemplified in FIG. 22, and described above, a user may be instructed to perform a routine with a matching exercise. For example, the apparatus may:

First instruction: GREEN—user must correctly match the cubby with the instruction such that they pick up the correct object.

Second instruction: RED—user should correctly match the cubby with the instruction such that they place the object in the correct cubby.

Simple modifications to this instruction pattern allow for more demanding forms of cognitive challenge. For example, the apparatus may provide a user with a series of instruction that they must remember. By way of example, a user may be presented with the following series of instructions:

RED→BLUE
BLUE→GREEN
GREEN→RED

The instructions may be removed from the user's vision or provided as an initial series of pulsed light flashes from the specified platforms. Thus, based on memory, a user must pick up and set down objects at the specified locations from memory, which substantially increases the mental processing to complete the routine. The difficulty may be increased even further by, for example, shifting the colors of the cubbies/platforms between repetitions, such that user must not only commit the series of instructions to memory, but also recognize the immediate changes to the location of the specified cubbies/platforms. Similarly, the difficulty may be increased by using weighted objects that are independently identifiable, e.g., using different colored objects. Thus, both locations on the apparatus and the objects' identities may be used as variables to challenge a subject's cognitive capabilities. In certain aspects, the apparatus uses, for example, conveyor belts as described herein to move objects around the apparatus. Their changing location provides another variable for users to account for during a routine—which provides another means for challenging cognitive ability.

In certain aspects, cognitive routines may be untimed, timed with a time limit, or time without a time limit.

In some examples, the difficulty level of the physical exercise and/or the cognitive exercise may be adjusted based on the user. For example, the difficultly level may be based on the user's previous scores, indicative, for example, of their accuracy or speed in completing a routine. In some instances, the difficulty level of the physical and/or the cognitive component of a routine may be adjusted based on a user's goals and/or progress. For example, a user may input user attributes, such as height, weight, and/or age. In some embodiments, the difficulty level of the physical and/or the cognitive exercise may be adjusted based on user input. Alternatively or additionally, the control module of the apparatus may adjust the difficulty based on a user's performance.

In certain aspects, harder routines or modes are gated to users until a certain score is achieved. A user may be presented with their progress towards the next routine in order to show progress and facilitate engagement.

In certain aspects, as a user completes cognitive training using an apparatus of the invention, the user may undergo a change in their sensory perception, cognitive faculty, and/or reaction speed as a result of increased brain plasticity.

Based on a user's performance, the apparatus may provide the user with feedback. Feedback may be provided to a user through graphics (e.g., using a display), indicator lights on the platforms, interactive sounds, and other modalities. In certain aspects, an apparatus of the invention may include a rehabilitation coach software module providing feedback to the user. A database module may store performance measures on patient performance (physical and or mental). A physical or occupational therapist may access the database, e.g., via cloud access, to assess a user's progress, provide updates to routines, and/or interface with the user.

In certain aspects, the apparatus may track, calculate, and display granular measures of a user's cognitive performance and/or improvement across multiple routines. These measures may be provided as scores based on a user's performance. A non-limiting set of measures may include:

SHORT-TERM MEMORY—measured based on a user's accuracy in completing a series of memorized instructions.

SHORT-TERM VISUAL MEMORY—a user's accuracy in completing a series of instruction temporarily displayed to a subject.

VISUAL DISCRIMINATION—accuracy and/or elapsed time in identifying a correct platform based on an instruction.

VISUAL TRACKING—following a displayed pattern of platforms from which objects are to be picked up and set down.

FOCUS—consistently following instructions in an accurate manner.

EXECUTIVE FUNCTION—measures accuracy, speed of completion, and proper form.

MULTI-TASKING

A different set of scores or metrics may be provided to users and medical professionals overseeing their cognitive training and assessment. For example, the apparatus may provide professionals with a subject's underlying performance metrics and/or scores with diagnostic utility. Simultaneously, users may receive a "gamified" score, that while providing feedback and an indication of progress, is easily understood by a user. This will help motivate users and promote repeated use.

EQUIVALENTS

Various modifications of the invention and many further embodiments thereof, in addition to those shown and described herein, will become apparent to those skilled in the art from the full contents of this document. The subject matter herein contains important information, exemplification and guidance that can be adapted to the practice of this invention in its various embodiments and equivalents thereof.

I claim:

1. An exercise apparatus comprising:

a central body comprising a base;

a plurality tubes, wherein each tube comprises an upper opening and lower opening; and one or more weighted objects, enabling a user to lift a weighted object from a lower opening of one of the tubes and depositing in the upper opening of one of the tubes such the object slides to a lower opening in of one of the tubes, wherein at least two tubes of the plurality intersect one another between their respective upper and lower openings.

2. The exercise apparatus of claim 1, wherein the intersection of the tubes comprises a flap that directs a weighted object deposited into an upper opening of a tube to slide into the lower opening of a desired tube.

3. The exercise apparatus of claim 2, wherein the apparatus further comprises a control module coupled to one or more sensors that detect the presence or absence of a weighted object inserted into the upper opening of each of the plurality of tubes.

4. The exercise apparatus of claim 3, wherein the apparatus further comprises one or more sensors coupled to the control module that detect the presence or absence of a weighted object at the lower opening of each of the plurality of tubes.

5. The exercise apparatus of claim 4, wherein the control module is coupled to an interface that provides instructions to the user.

6. The exercise apparatus of claim 5, wherein the control module comprises memory and processors that store programmed instructions of a programmed workout that when executed by the control module, cause the one or more processors to provide the user instructions for performing a workout via the interface.

* * * * *